US009791213B2

(12) United States Patent
Yoshioka et al.

(10) Patent No.: US 9,791,213 B2
(45) Date of Patent: Oct. 17, 2017

(54) HEAT EXCHANGER

(71) Applicant: DAIKIN INDUSTRIES, LTD., Osaka-shi, Osaka (JP)

(72) Inventors: Shun Yoshioka, Sakai (JP); Nobuhiko Matsuo, Sakai (JP); Shougo Ohta, Sakai (JP); Kanji Akai, Sakai (JP); Kento Kagohara, Sakai (JP); Kaori Yoshida, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 219 days.

(21) Appl. No.: 14/654,799

(22) PCT Filed: Nov. 19, 2013

(86) PCT No.: PCT/JP2013/081173
§ 371 (c)(1),
(2) Date: Jun. 22, 2015

(87) PCT Pub. No.: WO2014/103563
PCT Pub. Date: Jul. 3, 2014

(65) Prior Publication Data

US 2015/0338168 A1 Nov. 26, 2015

(30) Foreign Application Priority Data

Dec. 25, 2012 (JP) ..... 2012-281797
Sep. 30, 2013 (JP) ..... 2013-205780

(51) Int. Cl.
*F28F 7/00* (2006.01)
*F28D 7/00* (2006.01)
(Continued)

(52) U.S. Cl.
CPC ..... *F28D 7/0066* (2013.01); *F25B 39/04* (2013.01); *F28D 1/0333* (2013.01);
(Continued)

(58) Field of Classification Search
CPC .... F28D 7/0066; F28D 1/0333; F28D 1/0461; F28D 1/05391; F28D 7/0025; F28D 7/0083; F25B 39/04; F28F 1/40
(Continued)

(56) References Cited

U.S. PATENT DOCUMENTS 6,223,812 B1 5/2001 Gough
2008/0092587 A1 4/2008 Gorbounov et al.
(Continued)

FOREIGN PATENT DOCUMENTS

EP 1 462 750 A2 2/2004
EP 1 867 944 A2 12/2007
(Continued)

OTHER PUBLICATIONS

International Preliminary Report of corresponding PCT Application No. PCT/JP2013/081173 dated Jul. 9, 2015.
(Continued)

*Primary Examiner* — Davis Hwu
(74) *Attorney, Agent, or Firm* — Global IP Counselors, LLP

(57) ABSTRACT

A heat exchanger carries out heat exchange between a refrigerant that undergoes a phase change during heat exchange and another heating medium. The heat exchanger includes headers having the refrigerant flowing through interiors, a plurality of multi-hole first flat tubes, and a plurality of second flat tubes. The first flat tubes extend in a direction intersecting a lengthwise direction of the headers. The first flat tubes have a plurality of refrigerant flow channels with the refrigerant flowing through the refrigerant flow channels. The second flat tubes are stacked alternately with respect to the first flat tubes, with the other heating medium flowing through the second flat tubes. The headers are arranged to extend along a horizontal direction.

9 Claims, 21 Drawing Sheets

(51) Int. Cl.

| | |
|---|---|
| ***F28D 21/00*** | (2006.01) |
| ***F28F 1/40*** | (2006.01) |
| ***F28D 1/03*** | (2006.01) |
| ***F28D 1/04*** | (2006.01) |
| ***F28D 1/053*** | (2006.01) |
| ***F25B 39/04*** | (2006.01) |
| *F28F 1/02* | (2006.01) |
| *F28D 9/00* | (2006.01) |
| *F28F 9/02* | (2006.01) |

(52) U.S. Cl.
CPC ..... *F28D 1/0461* (2013.01); *F28D 1/05391* (2013.01); *F28D 7/0025* (2013.01); *F28D 7/0083* (2013.01); *F28D 21/00* (2013.01); *F28F 1/40* (2013.01); *F25B 2339/047* (2013.01); *F28D 9/0043* (2013.01); *F28D 2021/0061* (2013.01); *F28D 2021/0064* (2013.01); *F28F 1/022* (2013.01); *F28F 2009/0297* (2013.01)

(58) Field of Classification Search
USPC ..... 165/185
See application file for complete search history.

(56) References Cited

U.S. PATENT DOCUMENTS

2010/0307180 A1* 12/2010 Yamada ..... F25D 19/00 62/285
2013/0126127 A1 5/2013 Yoshimura et al.

FOREIGN PATENT DOCUMENTS

| | | | |
|---|---|---|---|
| JP | 11-23086 | A | 1/1999 |
| JP | 2007-17133 | A | 1/2007 |
| JP | 2008-528943 | A | 7/2008 |
| JP | 2009-204277 | A | 9/2009 |
| JP | 2009-287907 | A | 12/2009 |
| JP | 2011-33290 | A | 2/2011 |
| JP | 2012-202608 | A | 10/2012 |
| WO | 2012/017681 | A1 | 2/2012 |
| WO | 2012132924 | A1 | 10/2012 |

OTHER PUBLICATIONS

International Search Report of corresponding PCT Application No. PCT/JP2013/081173 dated Feb. 25, 2014.
European Search Report of corresponding EP Application No. 13 86 9525.9 dated Sep. 23, 2016.

* cited by examiner

HEAT EXCHANGER

CROSS-REFERENCE TO RELATED APPLICATIONS

This U.S. National stage application claims priority under 35 U.S.C. §119(a) to Japanese Patent Application Nos. 2012-281797, filed in Japan on Dec. 25, 2012 and 2013-205780, filed in Japan on Sep. 30, 2013, the entire contents of which are hereby incorporated herein by reference.

TECHNICAL FIELD

The present invention relates to a heat exchanger.

BACKGROUND ART

Heat exchangers constituted from a plurality of multi-hole flat tubes having formed in the interior thereof a plurality of refrigerant flow channels, and a plurality of flat tubes through the interior of which flows another heating medium, stacked in alternating fashion, exist in the prior art. As disclosed, e.g., in Japanese Laid-open Patent Application 2007-17133, such heat exchangers are constituted such that the ends of the respective multi-hole flat tubes connect to a header which extends in a direction intersecting a lengthwise direction of the multi-hole flat tubes, the refrigerant flow channels of the respective multi-hole flat tubes communicating via the internal space of the header.

SUMMARY

Technical Problem

In cases in which a refrigerant that undergoes a phase change during heat exchange is employed as the refrigerant flowing through the refrigerant flow channels of the multi-hole flat tubes, there are instances in which liquid refrigerant pools in the header interior, due to the refrigerant changing from a gas to a liquid during condensation. At such times, when the header is arranged so as to extend along a vertical direction, the refrigerant flow channels formed in the multi-hole flat tubes which, of the plurality of multi-hole flat tubes connected to the header, are those positioned at the bottom, will be submerged in the liquid refrigerant. Once this occurs, the amount of heat exchange declines in the multi-hole flat tubes which, of the plurality of multi-hole flat tubes, are those positioned at the bottom, thereby giving rise to the problem of diminished performance of the heat exchanger overall.

Accordingly, it is an object of the present invention to provide a heat exchanger with which diminished performance can be reduced.

Solution to Problem

The heat exchanger according to a first aspect of the present invention is a heat exchanger for carrying out heat exchange between a refrigerant that gives undergoes a phase change during heat exchange, and another heating medium, and is provided with headers, a plurality of multi-hole flat tubes, and a plurality of flat tubes. The refrigerant flows through the interior of the headers. The multi-hole flat tubes extend in a direction intersecting a lengthwise direction of the headers. Within the multi-hole flat tubes are formed a plurality of refrigerant flow channels through the interior of which the refrigerant flows. The flat tubes are stacked in alternating fashion with respect to the plurality of multi-hole flat tubes. The other heating medium flows through the interior of the flat tubes. Additionally, the headers are arranged in such a way as to extend along a horizontal direction.

Since the header is arranged to extend in a direction along the horizontal direction in the heat exchanger according to the first aspect of the present invention, even when the liquid refrigerant produced during condensation of the refrigerant pools in the header interior, the surface level of the pooled liquid refrigerant can be made lower than when the header of a heat exchanger of similar constitution is arranged to extend along the vertical direction. For this reason, the risk that the refrigerant flow channels of some of the multi-hole flat tubes will be immersed in the liquid refrigerant can be reduced, and as a result, uneven flow of the refrigerant in the multi-hole flat tubes can be reduced.

In so doing, diminished performance by the heat exchanger can be reduced.

The heat exchanger according to a second aspect of the present invention is the heat exchanger according to the first aspect, wherein the multi-hole flat tubes are arranged in such a way as to extend along the horizontal direction.

In cases in which the multi-hole flat tubes are divided among a plurality of paths, and are also arranged so as to extend along the vertical direction, the need arises to lift the condensed liquid refrigerant against gravity.

With the heat exchanger according to the second aspect of the present invention, the multi-hole flat tubes are arranged so as to extend along the horizontal direction, thereby eliminating the need to lift the liquid refrigerant against gravity as in the case in which the multi-hole flat tubes have been arranged so as to extend along the vertical direction. Therefore, instances of increased pressure loss of the refrigerant in the multi-hole flat tubes can be reduced to a greater extent than when the multi-hole flat tubes are arranged so as to extend along the vertical direction.

The heat exchanger according to a third aspect of the present invention is a heat exchanger according to the second aspect, wherein the plurality of refrigerant flow channels formed in the multi-hole flat tubes are arranged in such a way as to line up along the vertical direction. For this reason, with this heat exchanger, even when the refrigerant has condensed into liquid refrigerant, retention of the liquid refrigerant in the header interior can be reduced because the liquid refrigerant flows through those refrigerant flow channels which, of the plurality of refrigerant flow channels lined up along the vertical direction, are arranged towards the bottom.

The heat exchanger according to a fourth aspect of the present invention is a heat exchanger according to the third aspect, wherein, once the multi-hole flat tubes have been fitted into the header, a gap is present between the bottom surface of the header interior and the bottom end of the multi-hole flat tubes. For this reason, with this heat exchanger, space for the liquid refrigerant to pool at the bottom of the header can be ensured.

The heat exchanger according to a fifth aspect of the present invention is a heat exchanger according to the third or fourth aspect, wherein the flow channel cross-section of a lowermost tier refrigerant flow channel which, of the plurality of refrigerant flow channels, is that positioned lowermost, is greater than the flow channel cross-section of upper tier refrigerant flow channels positioned above the lowermost tier refrigerant flow channel. For this reason, with this heat exchanger, flow channel resistance in the lowermost tier refrigerant flow channel can be lowered. In so doing, the liquid refrigerant pooled within the header can flow smoothly.

The heat exchanger according to a sixth aspect of the present invention is a heat exchanger according to the fifth aspect, wherein grooves for heat transfer promotion are formed on surfaces constituting the upper tier refrigerant flow channels. The grooves are not formed on surfaces constituting the lowermost tier refrigerant flow channel. For this reason, the flow channel resistance in the lowermost tier refrigerant flow channel can be lowered to a greater extent that in the case in which grooves are formed on the surfaces constituting the lowermost tier refrigerant flow channel.

The heat exchanger according to a seventh aspect of the present invention is a heat exchanger according to any of the second to sixth aspects, wherein the header includes an inlet section for the refrigerant and an outlet section for the refrigerant. The plurality of flat tubes communicate via communicating portions which include an outlet, section for the other heating medium and an inlet section for the other heating medium. The communicating portions extend along a direction of extension of the header. The header is arranged such that the refrigerant outlet section side is positioned below the refrigerant inlet section side. With this heat exchanger, because the header is arranged so that the refrigerant outlet section side is positioned below the refrigerant inlet section side, the liquid refrigerant easily flows out from the outlet section, even when the refrigerant changes from a gas to a liquid during condensation.

In so doing, the risk of the liquid refrigerant collecting within the heat exchanger can be reduced.

The heat exchanger according to an eighth aspect of the present invention is a heat exchanger according to the seventh aspect, wherein the flat tubes include heat transfer portions contacting the multi-hole flat tubes. The communicating portions are arranged below the heat transfer portions. For this reason, the other heating medium is unlikely to collect within the heat transfer portion than in the case in which the communicating portions are arranged above the heat transfer portions, and the other heating medium having pooled in the heat exchanger can be easily discharged.

The heat exchanger according to a ninth aspect of the present invention is a heat exchanger according to the first aspect, wherein the multi-hole flat tubes are arranged in such a way as to extend along the vertical direction. For this reason, even when the liquid refrigerant is retained in the header interior, the inlets of the multi-hole flat tubes and the surface level of the liquid refrigerant are generally parallel, and the liquid refrigerant is easily distributed uniformly among the multi-hole flat tubes.

In so doing, uneven flow of the refrigerant can be reduced.

Advantageous Effects of Invention

With the heat exchanger according to the first aspect of the present invention, diminished performance of the heat exchanger can be reduced.

With the heat exchanger according to the second aspect of the present invention, instances of increased pressure loss of the refrigerant in the multi-hole flat tubes can be reduced.

With the heat exchanger according to the third aspect of the present invention, retention of the liquid refrigerant in the header interior can be reduced.

With the heat exchanger according to the fourth aspect of the present invention, space for the liquid refrigerant to pool at the bottom of the header can be ensured.

With the heat exchanger according to the fifth aspect of the present invention, the liquid refrigerant pooled within the header can flow smoothly.

With the heat exchanger according to the sixth aspect of the present invention, flow channel resistance in the lowermost tier refrigerant flow channel can be lowered.

With the heat exchanger according to the seventh aspect of the present invention, the risk of the liquid refrigerant collecting within the heat exchanger can be reduced.

With the heat exchanger according to the eighth aspect of the present invention, the other heating medium having pooled in the heat exchanger can be easily discharged.

With the heat exchanger according to the ninth aspect of the present invention, uneven flow of the refrigerant in the plurality of multi-hole flat tubes can be reduced.

BRIEF DESCRIPTION OF THE DRAWINGS

FIG. 8B is a cross-sectional view of a refrigerant header.

DESCRIPTION OF EMBODIMENTS

Embodiments of the present invention are described below with reference to the accompanying drawings. The embodiments of the heat exchanger according to the present invention are not limited to those described hereinbelow; and modifications are possible without departing from the scope and spirit of the invention.

A heat exchanger 10 according to the present invention is a heat exchanger for carrying out heat exchange between a refrigerant that undergoes a phase change during heat exchange, such as an HFC refrigerant including R407C, R410A, R134a, and R32, and an HFO refrigerant including 2,3,3,3-tetrafluoro-1-propane (HFO-1234yf), and another heating medium. The refrigerants used are presumed to not include carbon dioxide ($CO_2$) refrigerants. A case in which water is employed as the other heating medium for carrying out heat exchange with the refrigerant is disclosed below by way of example, but the other heating medium is not limited to water.

(1) Constitution of Heat Pump-Type Hot Water Supply Apparatus

Figure 1:
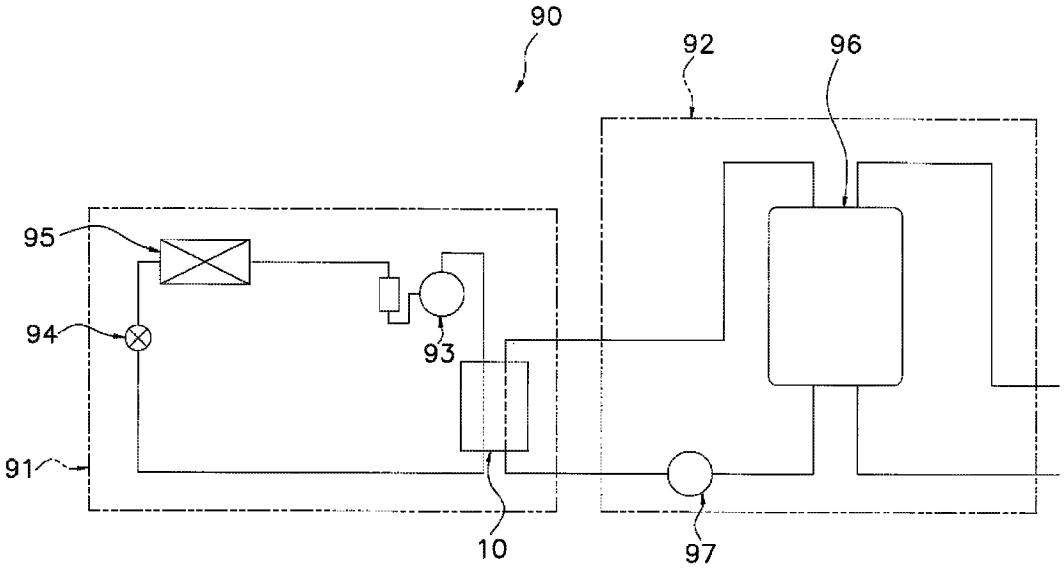
FIG. 1 is a diagram showing a heat pump-type hot water supply apparatus provided with a heat exchanger.

As shown in FIG. 1, a heat pump-type hot water supply apparatus 90 is provided with a refrigeration apparatus 91 which is a warm water heat source apparatus and a hot water unit 92.

The refrigeration apparatus 91 has a compressor 93 for compressing the refrigerant, a heat exchanger 10 for carrying heat exchange between the refrigerant and the water, an expansion valve 94 as a refrigerant pressure reduction means, and an air heat exchanger 95 for carrying out heat exchange between the outside air and the refrigerant. On the refrigeration apparatus 91 side, the compressor 93, the heat exchanger 10, the expansion valve 94, and the air heat exchanger 95 are connected, and constitute a refrigerant circuit for circulating the refrigerant.

The hot water unit 92 is provided with a hot water tank 96, and a water circulation pump 97. On the hot water unit 92 side, the heat exchanger 10, the hot water tank 96, and the water circulation pump 97 are connected, and constitute a water circulation circuit for circulating the water.

Figure 2:
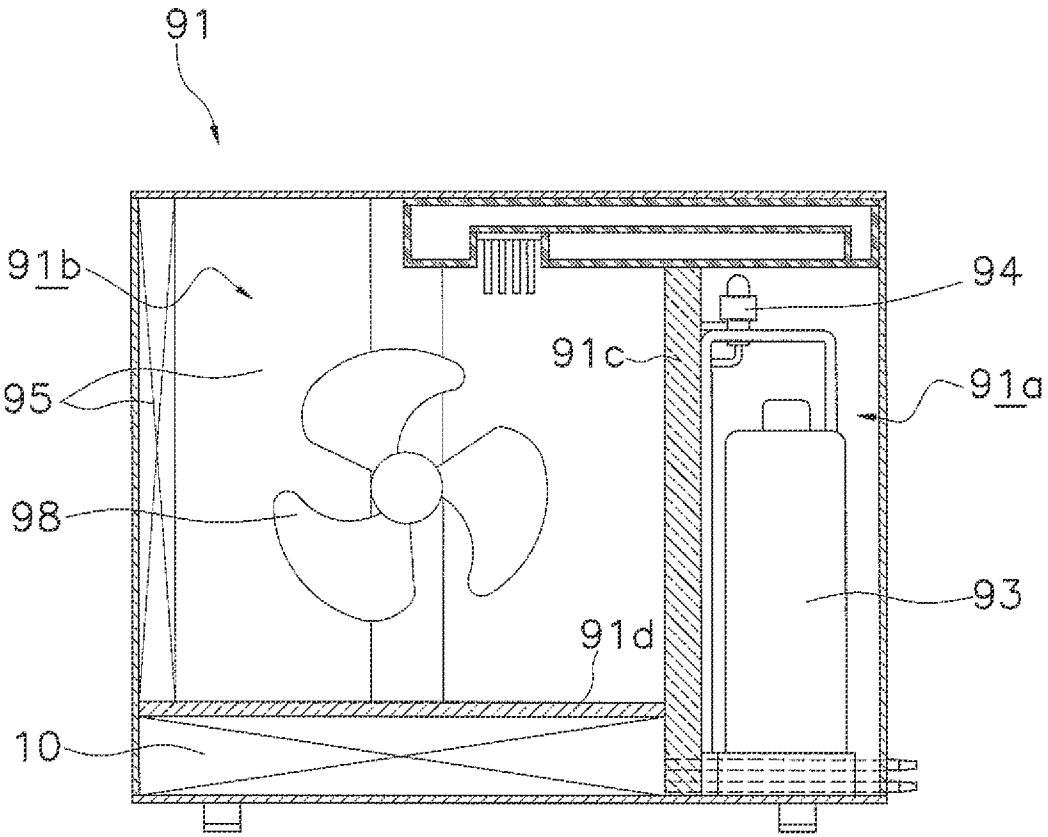
FIG. 2 is a view showing the internal structure of a refrigeration apparatus.

FIG. 2 is a schematic view showing the internal structure of the refrigeration apparatus 91. In FIG. 2, a compartment to the right side of an adiabatic wall 91*c* serves as a machine compartment 91*a*, and a compartment to the left side of the adiabatic wall 91*c* serves as a blower chamber 91*b*. The compressor 93 and/or the expansion valve 94 are arranged in the machine compartment 91*a*. A fan 98 driven by a motor (not shown) is arranged in the blower chamber 91*b*.

The heat exchanger 10 is arranged below the blower chamber 91*b*, to the other side of an adiabatic wall 91*d*. Within the heat exchanger 10, heat exchange is carried out between the refrigerant circulating through the refrigerant circuit, and the water circulating through the water circulation circuit. In FIG. 2, the air heat exchanger 95 is arranged to the left side and the rear side of the blower chamber 91*b*.

(2) Constitution of Heat Exchanger

Figure 3:
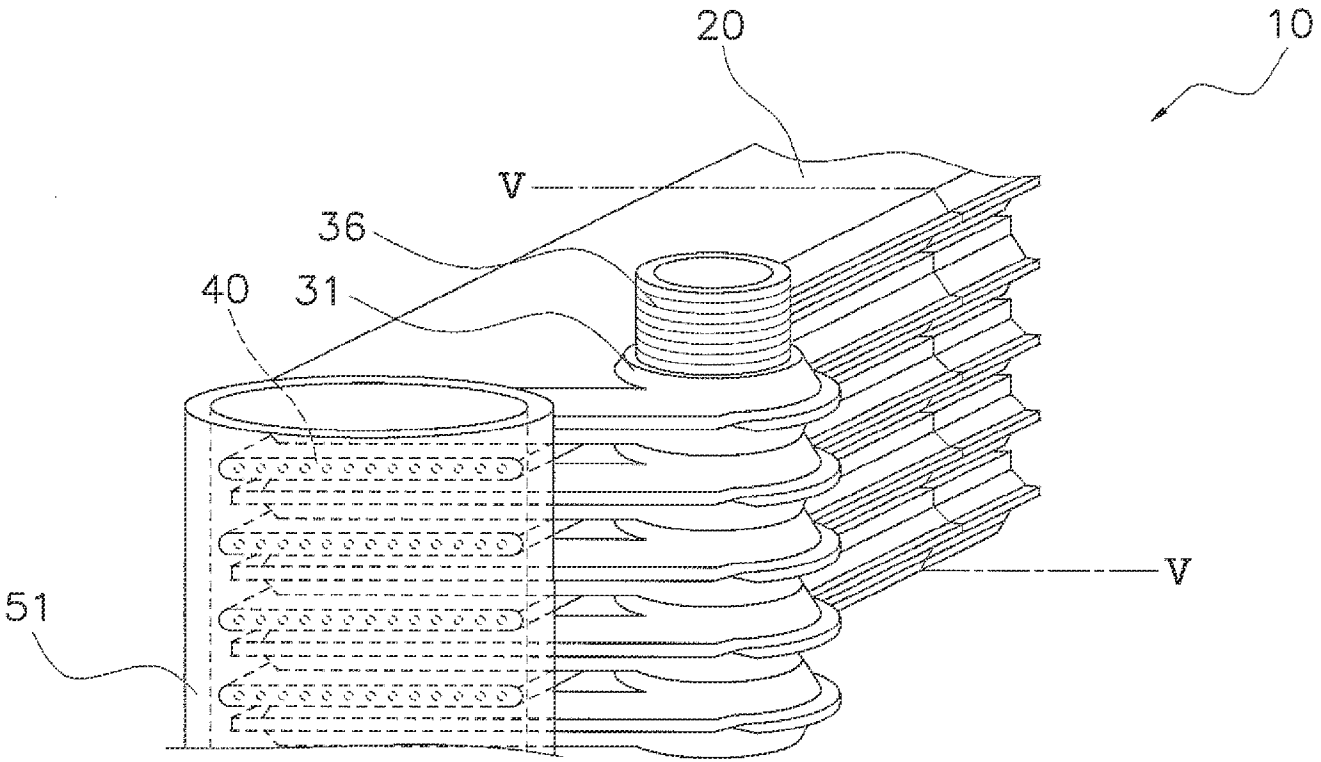
FIG. 3 is a view showing a portion of the exterior of a heat exchanger.
Figure 4:
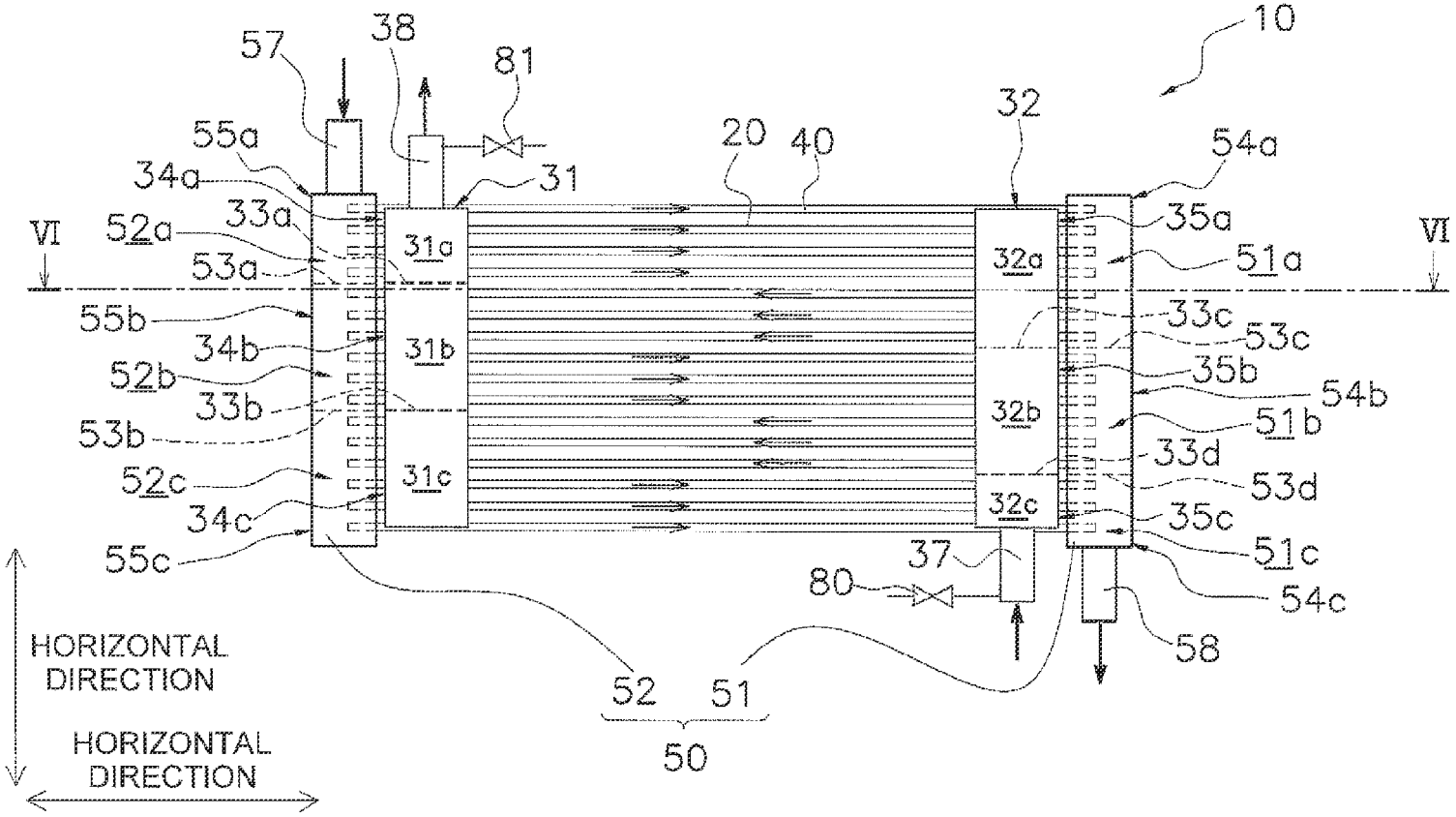
FIG. 4 is a simplified schematic view of a heat exchanger, shown as installed by the installation means of the present embodiment.
Figure 5:
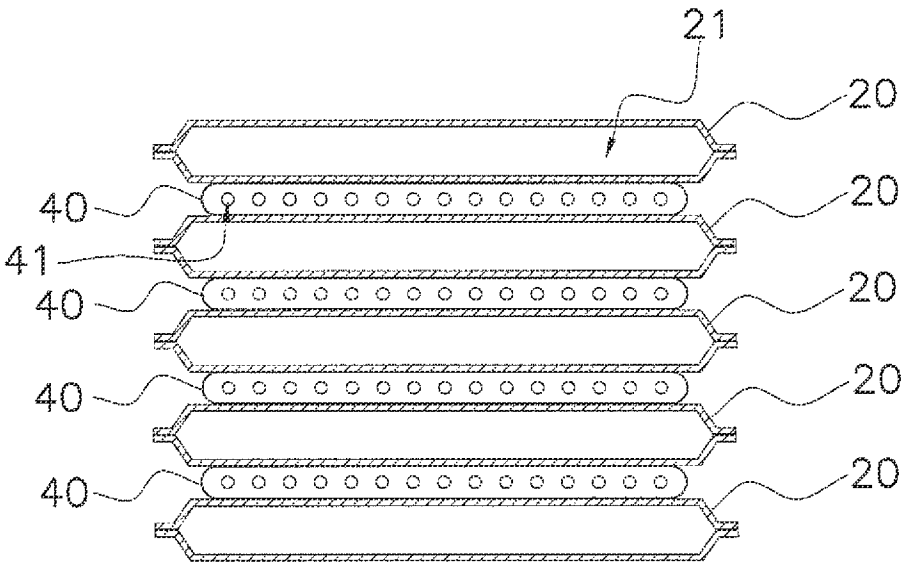
FIG. 5 is a cross-sectional view of a heat exchanger.
Figure 6:
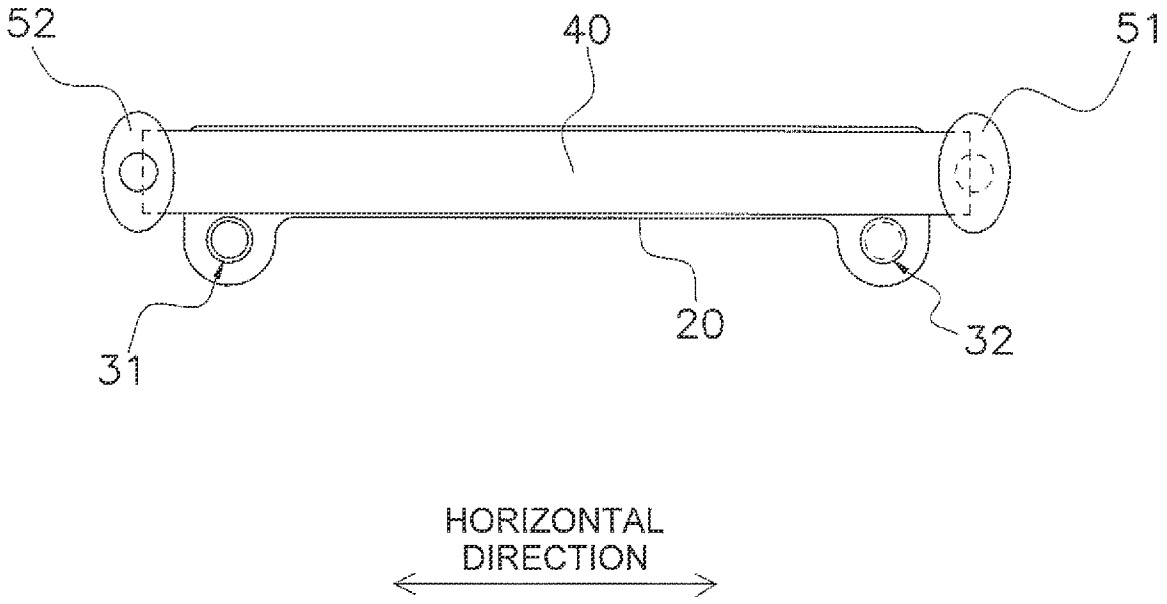
FIG. 6 is a cross-sectional view of a heat exchanger.

FIG. 3 is a view showing part of the exterior of the heat exchanger 10. FIG. 4 is a simplified schematic view of the heat exchanger 10. FIG. 5 is a cross-sectional view of FIG. 3 across line V-V. FIG. 6 is a VI-VI cross-sectional view of FIG. 4.

The heat exchanger 10 is a stacked plate water heat exchanger for heat exchange between the refrigerant and the water, and includes a plurality of flat tubes 20, a plurality of multi-hole flat tubes 40, and refrigerant headers 50 which extend in a direction intersecting a lengthwise direction of the multi-hole flat tubes 40 (see FIGS. 3, 4, and 5). The respective flat tubes 20 communicate through communicating portions 31, 32, which are positioned in proximity to either end of the flat tubes 20 and extend along the direction of extension of the refrigerant headers 50. In the heat exchanger 10 of the present embodiment, 15 flat tubes 20 and 16 multi-hole flat tubes 40 are stacked in alternating fashion. However, the number of stacked flat tubes 20 and/or multi-hole flat tubes 40 may be selected, as appropriate, according to the required performance, and may be greater than, or less than, the number employed in the present embodiment.

The water flows through the flat tubes 20, and the refrigerant at high pressure flows through the multi-hole flat tubes 40. For this reason, the multi-hole flat tubes 40 are required to have higher pressure resistance than of the flat tubes 20. Consequently, the interiors of the multi-hole flat tubes 40 are furnished with a plurality of fine refrigerant flow channels 41 which extend in the lengthwise direction of the multi-hole flat tubes 40. The multi-hole flat tubes 40 are formed from aluminum, aluminum alloy, copper alloy, stainless steel, or the like. To form the multi-hole flat tubes 40 having the plurality of fine refrigerant flow channels 41, it is suitable for an aluminum and an aluminum alloy to be drawn and/or extruded.

A high degree of corrosion resistance is required of the flat tubes 20 through the interior of which the water flows. For this reason, it is preferable for the flat tubes 20 to be formed of stainless steel and/or a copper alloy. While the flat tubes 20 could be formed from aluminum and/or an aluminum alloy, in this case, it will be preferable to carry out an anticorrosion treatment, such as an alumite process or resin process coating, on the inside surfaces that will serve as the flow channel 21 for the water. A single flat tube 20 is constituted by superimposing a pair of metal plates formed by pressing metal panels (made of, e.g., stainless steel), and brazing or welding the outside peripheral edges thereof together. The metal plates constituting the flat tube 20 may have dimples and/or chevrons formed thereon, for promoting heat transfer.

Further, in FIG. 4, which is a view showing the heat exchanger 10 in a state of arrangement such that the flat tubes 20, the multi-hole flat tubes 40, and the refrigerant headers 50 extend along the horizontal direction, the communicating portion 32 at the side that includes the inlet section 37 for water into the heat exchanger 10 is arranged in proximity to the right end portions of the flat tubes 20, and the communicating portion 31 at the side that includes the outlet section 38 for water from the heat exchanger 10 is arranged in proximity to the left end portions of the flat tubes 20. The inlet section 37 and the outlet section 38 are respectively furnished with an inlet-side cock 80 and an outlet-side cock 81. The inlet section 37 and the outlet section 38 of the communicating portions 31, 32 are also furnished with an inlet/outlet port 36 that connects to a pipeline or the like (see FIG. 3).

As shown in FIG. 4, the respective internal spaces of the communicating portions 31, 32 are partitioned into three spaces by partition portions 33*a*, 33*b*, 33*c*, and 33*d*. In more detail, the communicating portion 31 is furnished with the partition portions 33*a*, 33*b*, and the partition portions 33*a*, 33*b* partition the communicating portion 31 into a first space 31*a*, a second space 31*b*, and a third space 31*c*. The communicating portion 32 is furnished with the partition portions 33*c*, 33*d*, and the partition portions 33*c*, 33*d* partition the communicating portion 32 into a first space 32*a*, a second space 32*b*, and a third space 32*c*. For this reason, the communicating portion 31 includes a first section 34*a* constituting the first space 31*a*, a second section 34*b* constituting the second space 31*b*, and a third section 34*c* constituting the third space 31*c*. The communicating portion 32 includes a first section 35*a* constituting the first space 32*a*, a second section 35*b* constituting the second space 32*b*, and a third section 35*c* constituting the third space 32*c*.

By virtue of this constitution, in FIG. 4, at the flat tube 20 side, the water enters the third section 35*c* from the inlet section 37 of the communicating portion 32, branches into three of the flat tubes 20 and flows from right to left therein, then converges in the third section 34*c* of the communicating portion 31. Having converged, the water branches from the third section 34*c* into three of the flat tubes 20 and flows from left to right therein, then converges in the second section 35*b* of the communicating portion 32. Having converged, the water branches from the second section 35*b* into three of the flat tubes 20 and flows from right to left therein, then converges in the second section 34*b* of the communicating portion 31. Having converged, the water branches from the second section 34*b* into three of the flat tubes 20 and flows from left to right therein, then converges in the first section 35*a* of the communicating portion 32. Having converged, the water branches from the first section 35*a* into three of the flat tubes 20 and flows from right to left therein, then converges in the first section 34*a* of the communicating portion 31, and flows out from the heat exchanger 10 through the outlet section 38 of the communicating portion 32. While flowing through the flat tubes 20, the water is heated by heat from the refrigerant in the multi-hole flat tubes 40.

The refrigerant headers 50 are arranged at either end in the lengthwise direction of the multi-hole flat tubes 40 which extend in linear fashion. Hereinafter, in FIG. 4, which shows the heat exchanger 10 in a state of arrangement such that the flat tubes 20, the multi-hole flat tubes 40, and the refrigerant headers 50 extend along the horizontal direction, the refrigerant header arranged at the right ends of the multi-hole flat tubes 40 is denoted by symbol 51, and the refrigerant header arranged at the left ends is denoted by symbol 52.

As shown in FIG. 4, the refrigerant headers 51, 52 are furnished with partition panels 53*a*, 53*b*, 53*c*, 53*d* which partition the interior spaces thereof into three spaces. In more detail, the partition panels 53*a*, 53*b*, 53*c*, 53*d* extend in a direction intersecting the direction of extension of the refrigerant headers 51, 52. The partition panels 53*c*, 53*d* partition the refrigerant header 51 into a first space 51*a*, a second space 51*b*, and a third space 51*c*. The partition panels 53*a*, 53*b* partition the refrigerant header 52 into a first space 52*a*, a second space 52*b*, and a third space 52*c*. For this reason, the refrigerant header 51 includes a first header part 54*a* constituting the first space 51*a*, a second header part 54*b* constituting the second space 51*b*, and a third header part 54*c* constituting the third space 51*c*. The refrigerant header 52 includes a first header part 55*a* constituting the first space 52*a*, a second header part 55*b* constituting the second space 52*b*, and a third header part 55*c* constituting the third space 52*c*.

At the multi-hole flat tube 40 side in FIG. 4, the refrigerant thus enters the first header part 55*a* from the inlet section 57 of the refrigerant header 52, branches into four of the multi-hole flat tubes 40 and flows from left to right therein, and converges in the first header part 54*a* of the refrigerant header 51. Having converged, the refrigerant branches from the first header part 54*a* into three of the multi-hole flat tubes 40 and flows from right to left therein, and converges in the second header part 55*b* of the refrigerant header 52. Having converged, the refrigerant branches from the second header part 55*b* into three of the multi-hole flat tubes 40 and flows from left to right therein, and converges in the second header part 54*b* of the refrigerant header 51. Having converged, the refrigerant branches from the second header part 54*b* into three of the multi-hole flat tubes 40 and flows from right to left therein, and converges in the third header part 55*c* of the refrigerant header 52. Having converged, the refrigerant branches from the third header part 55*c* into three of the multi-hole flat tubes 40 and flows from left to right therein, converges in the third header part 54*c* of the refrigerant header 51, and outflows from the heat exchanger 10 through the outlet section 58 of the refrigerant header 51. While flowing through the multi-hole flat tubes 40, the refrigerant loses heat to the water in the flat tubes 20.

Here, the communicating portions 31, 32 and the refrigerant headers 51, 52 have been respectively partitioned into three spaces; however, this number is not provided by way of limitation. It would also be acceptable to not partition the internal spaces of the communicating portions 31, 32 and the refrigerant headers 51, 52.

The heat exchanger 10 is constituted by fitting an assembly formed of the flat tubes 20 into an assembly formed of the multi-hole flat tubes 40 and the refrigerant headers 50, and soldering or welding the joining sections of the flat tubes 20 and the multi-hole flat tubes 40 together in a site of stacking the flat tubes 20 and the multi-hole flat tubes 40 alternately. The assembly formed of the flat tubes 20 is constituted by soldering or welding the flat tubes 20 as they are being stacked, and the assembly formed of the multi-hole flat tubes 40 and the refrigerant headers 50 is constituted by fitting the multi-hole flat tubes 40 into the refrigerant headers 50 and soldering or welding them together. At this time, the partition portions 33*a*, 33*b*, 33*c*, and 33*d* of the communicating portions 31, 32 are not subjected to brazing or the like, so that the thermal conductivity does not decline.

(3) Installation State of Heat Exchanger

Figure 7:
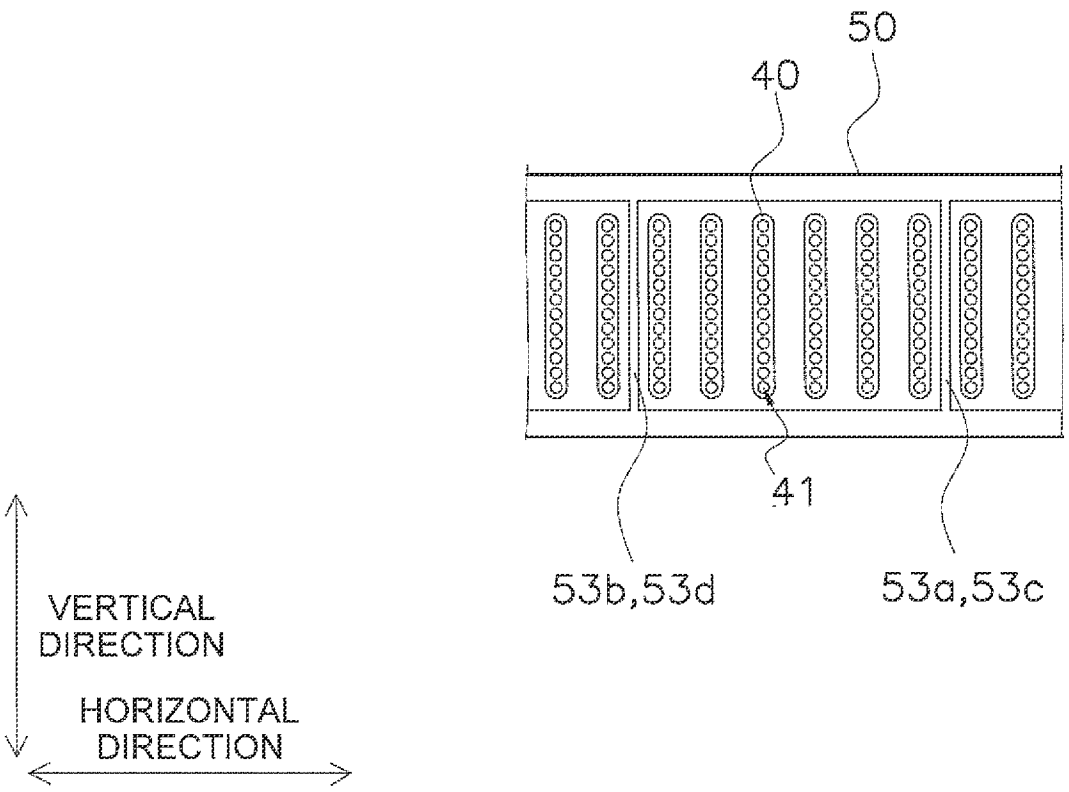
FIG. 7 is a cross-sectional view of a refrigerant header.
Figure 8A:
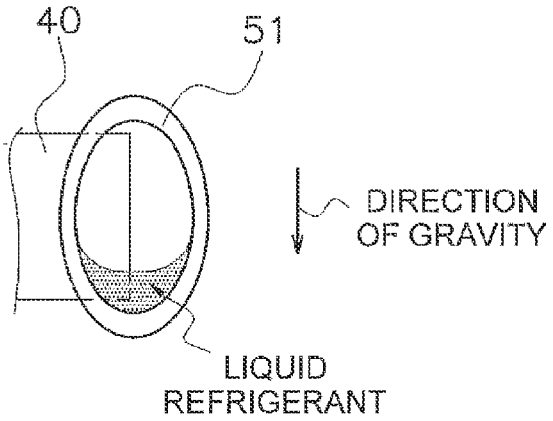
FIG. 8A is a view depicting state in which a liquid refrigerant has pooled in a refrigerant header interior.
Figure 8A:
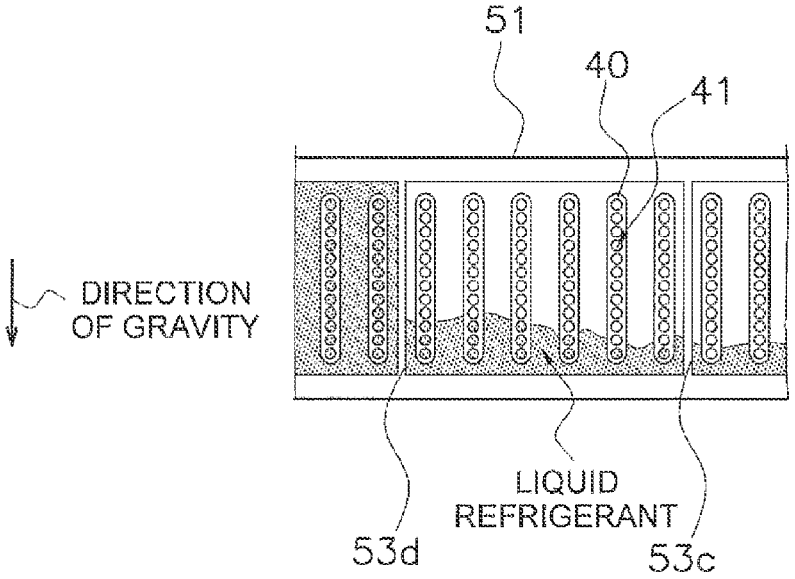

FIG. 7 is a cross-sectional view of case in which the refrigerant header 50 has been cut along the lengthwise direction thereof, when the heat exchanger 10 has been installed in a state with the refrigerant headers 50 and the multi-hole flat tubes 40 arranged extending along the horizontal direction. FIG. 8A (a) is a cross-sectional view of a case in which the refrigerant header 50 has been cut along a direction orthogonal to the lengthwise direction thereof, when the heat exchanger 10 has been installed in a state with the refrigerant headers 50 and the multi-hole flat tubes 40 arranged extending along the horizontal direction. FIG. 8A (b) is a cross-sectional view of a case in which the refrigerant header 50 has been cut along the lengthwise direction thereof, when the heat exchanger 10 has been installed, in a state with the refrigerant headers 50 and the multi-hole flat tubes 40 arranged extending along the horizontal direction. The "refrigerant headers 50 being arranged so as to extend along the horizontal direction" herein refers to a range of instances from those in which the refrigerant headers 50 are not inclined at all with respect to a horizontal plane, to those in which they inclined by about ±15° with respect to a horizontal plane.

In the present embodiment, the heat exchanger 10, oriented in a state in which the refrigerant headers 50 and the multi-hole flat tubes 40 are arranged so as to extend along the horizontal direction (a state of zero inclination with respect to a horizontal plane), is installed within the refrigeration apparatus 91. Specifically, FIG. 4 shows the heat exchanger 10 as-installed installation by the installation means of the present embodiment, viewed from above. By arranging the refrigerant headers 50 and the multi-hole flat tubes 40 so as to extend along the horizontal direction, the plurality of refrigerant flow channels 41 (in the present embodiment, 12) formed in the multi-hole flat tubes 40 are arranged so as to line up along the vertical direction, as shown in FIG. 7. Herein, the "plurality of refrigerant flow channels 41 are arranged so as to line up along the vertical direction" refers to a range of instances from those in which the plurality of refrigerant flow channels 41 are not inclined at all with respect to a vertical plane, to those in which they inclined by about ±15° with respect to a vertical plane. By installing the heat exchanger 10 in this manner, even when the gaseous refrigerant condenses and changes phase into a liquid refrigerant, the liquid refrigerant pools in the bottom part of the refrigerant header 50 due to gravity as shown in FIG. 8A, and is thereby transported from the refrigerant flow channel 41 that, of the refrigerant flow channels 41 lined up along the vertical direction, is positioned at the bottom, so that retention of the liquid refrigerant within the refrigerant header 50 can be minimized.

Moreover, as shown in FIG. 8B, in the present embodiment, once the heat exchanger 10 has been installed there is a gap S between the bottom face 50*a* of the refrigerant header 50 interior and the bottom end 40*a* of the multi-hole flat tube 40. By furnishing the gap S between the bottom face 50*a* of the refrigerant header 50 interior and the bottom end 40*a* of the multi-hole flat tube 4 when the multi-hole flat tube 40 is fitted into the refrigerant header 50, space for the liquid refrigerant to pool in the bottom part of the refrigerant header 50 can thus be ensured. Consequently, as the liquid refrigerant pools in the space and the surface level rises, the liquid refrigerant can be expelled from the refrigerant flow channel 41 that, of the refrigerant flow channels 41 lined up in the vertical direction, is positioned in the lowermost part.

(4) Characteristics (4-1)

Figure 9:
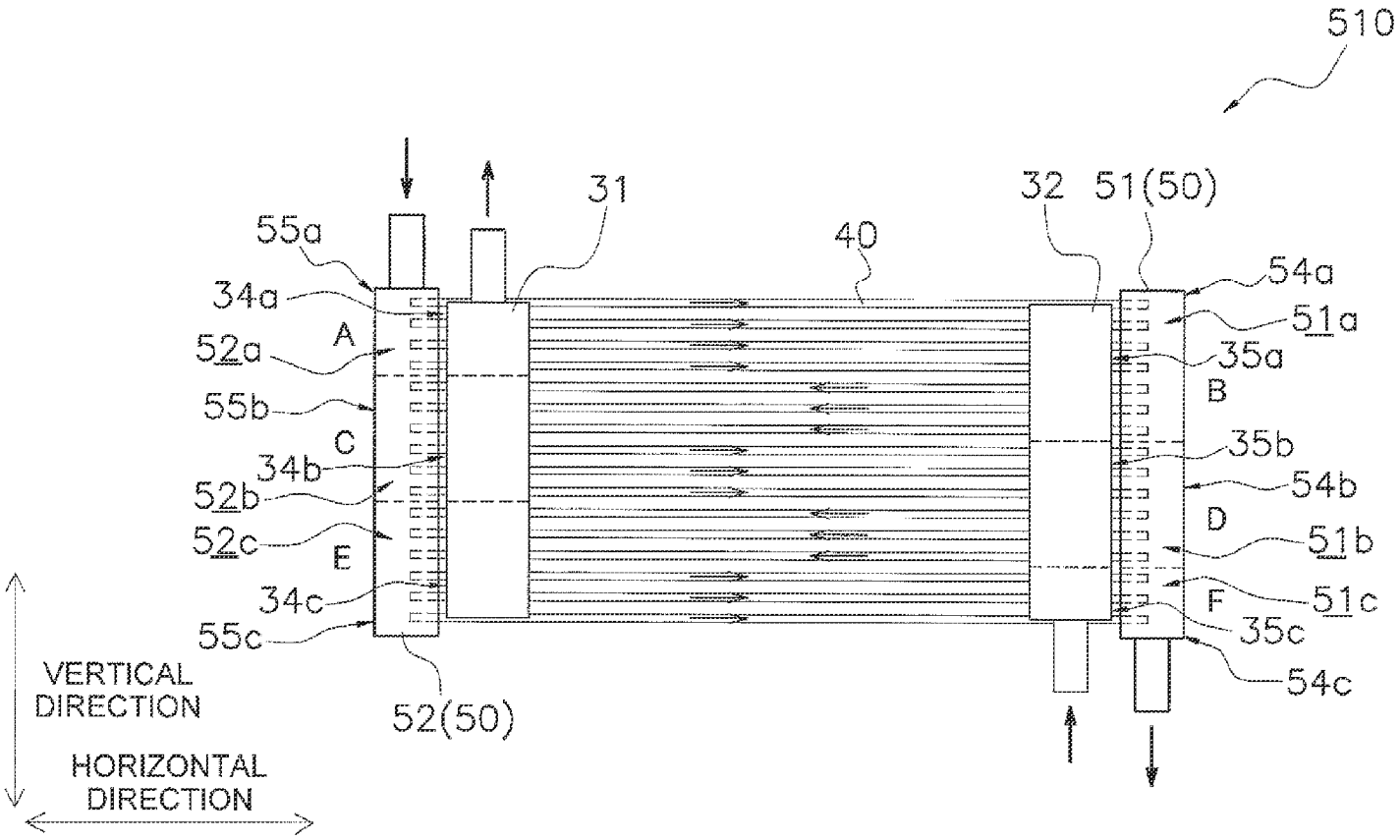
(PRIOR ART) FIG. 9
FIG. 9 is a simplified schematic view of a heat exchanger, shown as installed by conventional installation means.
Figure 10:
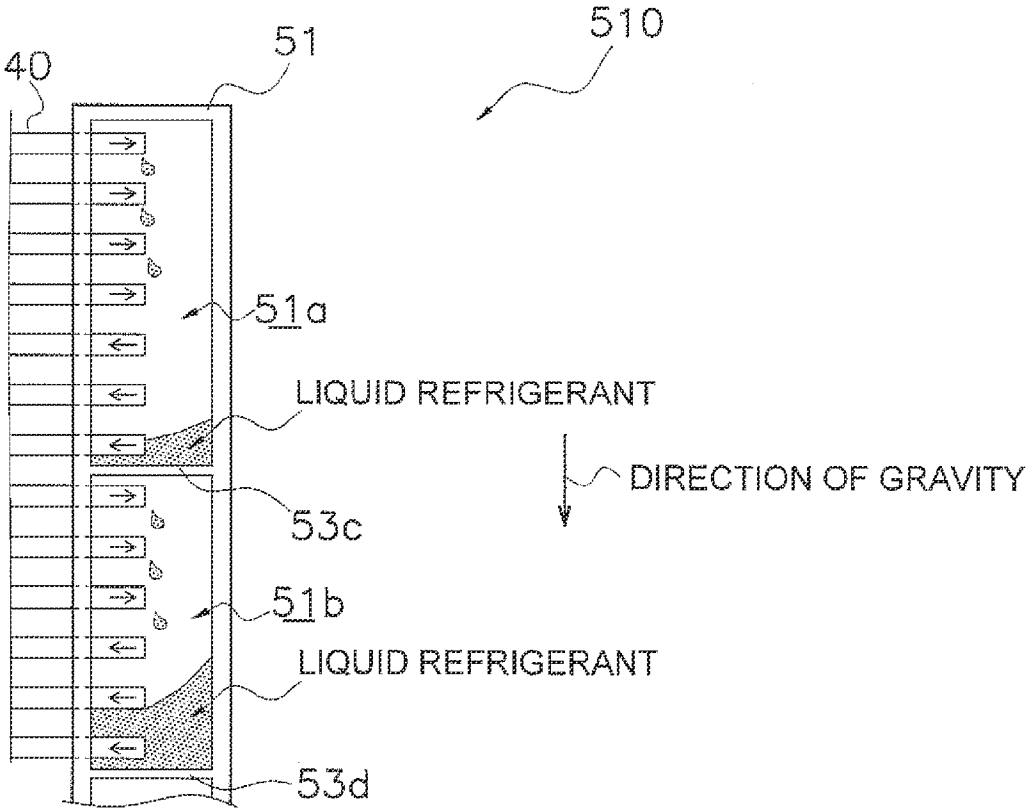
(PRIOR ART) FIG. 10
FIG. 10 is a view describing a state in which a liquid refrigerant has pooled in the refrigerant header interior.
Figure 11:
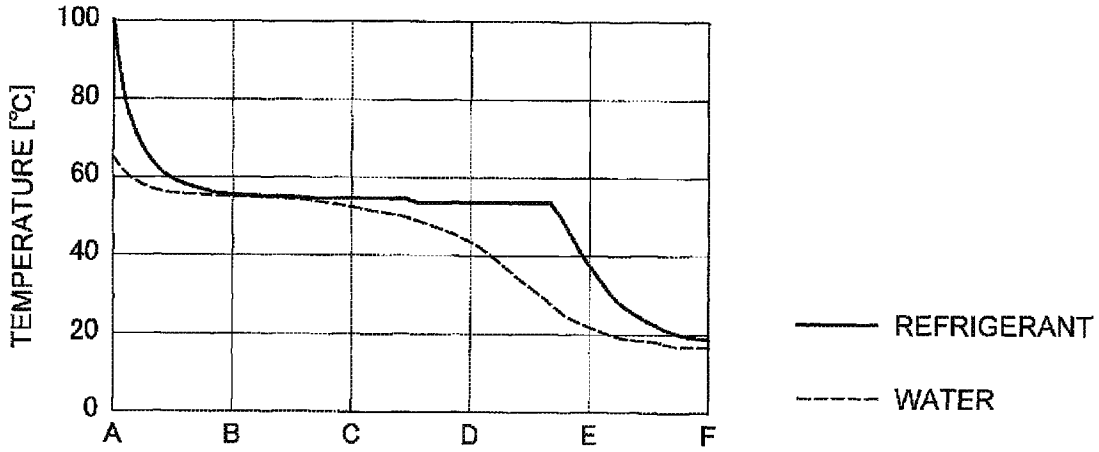
(PRIOR ART) FIG. 11
FIG. 11 is a view showing a refrigerant and water temperature distribution.

FIG. 9 is a view of a heat exchanger of the same configuration as the heat exchanger 10 of the present embodiment, shown in a state of being installed in a state in which the refrigerant headers 50 are arranged extending along the vertical direction (top-to-bottom direction), and the multi-hole flat tubes 40 are arranged extending along the horizontal direction. FIG. 10 is a view of the heat exchanger installed in the state shown in FIG. 9, showing a state in which, in a case in which gaseous refrigerant has condensed into liquid refrigerant, the liquid refrigerant pools in the refrigerant header 50 interior. FIG. 11 is a view of predicted temperature distribution of the refrigerant and the water at points (A-F) in the heat exchanger installed in the state shown in FIG. 9. Hereinbelow, the heat exchanger installed in the state shown in FIG. 9, i.e., in a state in which the refrigerant headers 50 are arranged extending along the vertical direction and the multi-hole flat tubes 40 are arranged extending along the horizontal direction, is denoted by symbol 510. In FIG. 11, point A refers to the first header part 55*a* and the first section 34*a* in FIG. 9, point B refers to the first header part 54*a* and the first section 35*a* in FIG. 9, point C refers to the second header part 55*b* and the second section 34*b* in FIG. 9, point D refers to the second header part 54*b* and the second section 35*b* in FIG. 9, point E refers to the third header part 55*c* and the third section 34*c* in FIG. 9, and point F refers to the third header part 54*c* and the third section 35*c* in FIG. 9.

In the heat exchanger 510 constituted by stacking the plurality of multi-hole flat tubes 40 and the plurality of flat tubes 20 in alternating fashion, in cases in which a refrigerant that undergoes a phase change during heat exchange is employed as the refrigerant flowing through the refrigerant flow channels 41 of the multi-hole flat tubes 40, when the refrigerant headers 51, 52 are arranged to extend along the vertical, direction as shown in FIG. 9, due to gravity, the liquid refrigerant produced during condensation is retained respectively in the bottom parts of the first spaces 51*a*, 52*a*, the second spaces 51*b*, 52*b*, and the third spaces 51*c*, 52*c* which are provided in the refrigerant headers 51, 52 (see FIG. 10). Thus, all of the refrigerant flow channels 41 of the multi-hole flat tubes 40 that, of the plurality of multi-hole flat tubes 40 connected to the refrigerant headers 50, are those positioned at the bottom parts of the spaces 51*a*, 52*a*, 51*b*, 52*b*, 51*c*, 52*c* are submerged in the liquid refrigerant. In this case, the overall, function of the heat exchanger 510 will be diminished due to a decline in the amount of heat exchange by the multi-hole flat tubes 40.

In the present embodiment, when the heat exchanger 10 is installed in the refrigeration apparatus 91, the refrigerant headers 50 are arranged so as to extend along the horizontal direction. For this reason, as shown in FIG. 9, as compared with the case in which the refrigerant headers are arranged to extend along the vertical direction, even when the liquid refrigerant produced during refrigerant condensation has pooled in the refrigerant header 50 interior, the surface level height of the pooled refrigerant can be lowered. Consequently, as shown in FIG. 10, with this heat exchanger 10, the risk that all of the refrigerant flow channels 41 of the prescribed multi-hole flat tubes 40 will become submerged in the liquid refrigerant can be reduced, and as a result, uneven flow of the refrigerant in the multi-hole flat tubes 40 can be reduced.

In so doing, diminished performance of the heat exchanger 10 can be reduced.

(4-2)

When a heat exchanger of the same configuration as that of the present embodiment has been installed in a refrigeration apparatus, in cases in which the multi-hole flat tubes are arranged to extend along the vertical direction, it will be necessary to lift the condensed liquid refrigerant against gravity.

In the present embodiment, when the heat exchanger 10 is installed within the refrigeration apparatus 91, the multi-hole flat tubes 40 are arranged to extend along the horizontal direction. By arranging the multi-hole flat tubes 40 to extend along the horizontal direction in this manner, there is no need to lift the liquid refrigerant against gravity, as is the case in which the multi-hole flat tubes are arranged to extend along the vertical direction, and therefore increase in pressure loss can be kept smaller than when the multi-hole flat tubes are arranged to extend along the vertical direction.

(4-3)

In the present embodiment, when the heat exchanger 10 is installed within the refrigeration apparatus 91, the plurality of refrigerant flow channels 41 formed in the multi-hole flat tubes 40 are arranged to line up along the vertical direction. For this reason, even if gaseous refrigerant condenses into liquid refrigerant, the liquid refrigerant is transported from a refrigerant flow channel 41 that, of the refrigerant flow channels 41 lined up along the vertical direction, is one positioned to the bottom.

In so doing, retention of the liquid refrigerant in the refrigerant header 50 interior can be minimized.

Even in cases in which the liquid refrigerant flows through a refrigerant flow channel 41 that, of the refrigerant flow channels 41 lined up along the vertical direction, is one positioned at the bottom, the temperature differential between the liquid refrigerant and the water is small, but by employing highly heat-conductive aluminum as the parent material of the multi-hole flat tubes 40, decline of the temperature differential can be ameliorated, and therefore the effect on reducing the amount of heat exchange can be lowered.

(5) Modifications (5-1) Modification A

Figure 12:
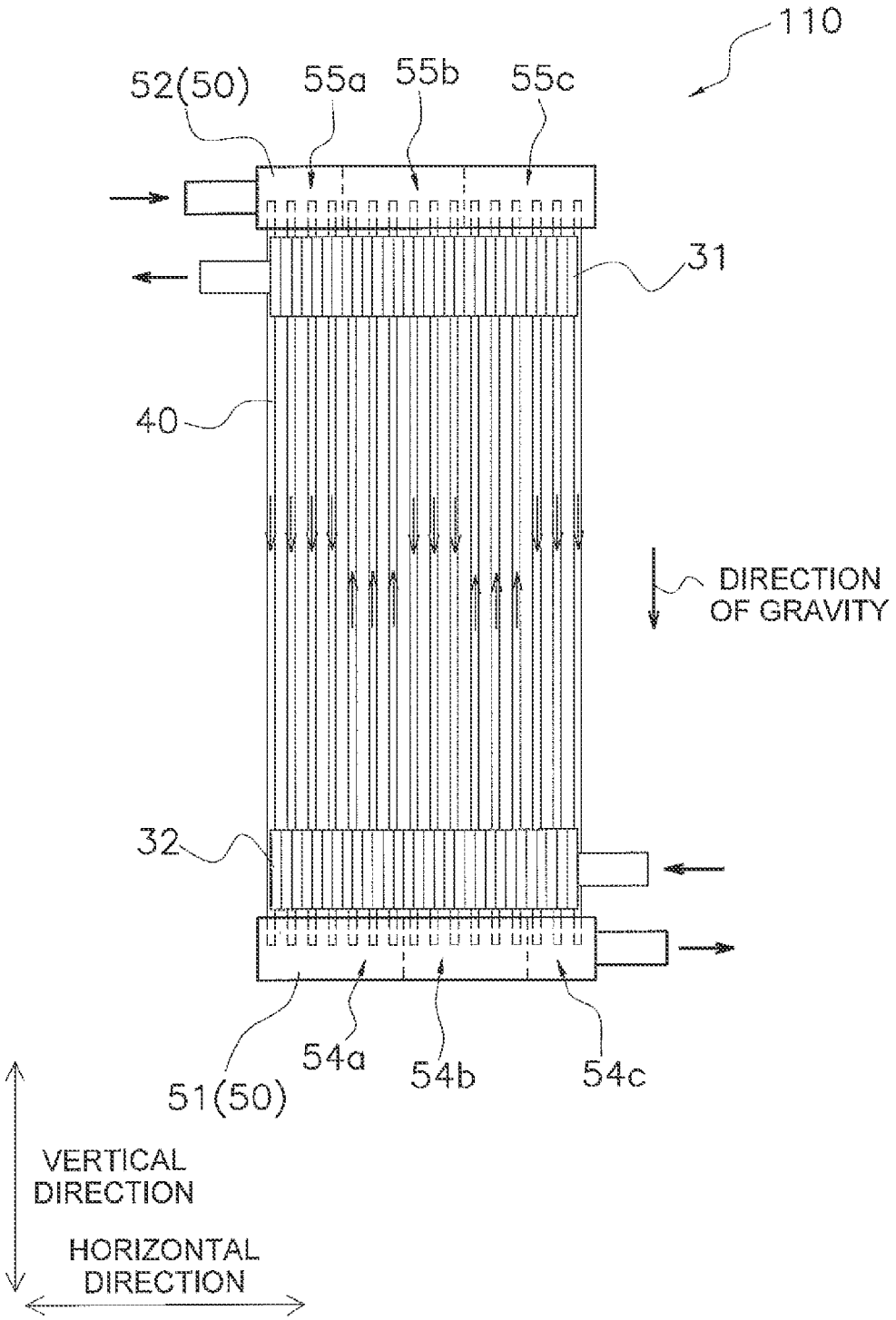
FIG. 12 is a simplified schematic view of a heat exchanger, shown as installed by installation means according to a Modification A.
Figure 13:
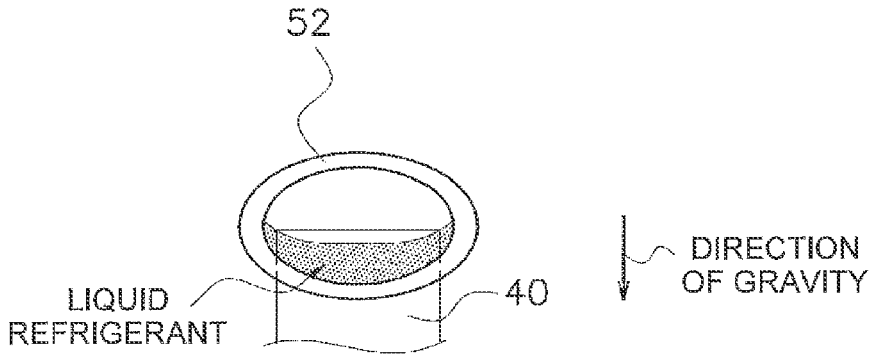
FIG. 13 is a view describing a state in which a liquid refrigerant has pooled in the interior of a refrigerant header arranged at the top.
Figure 13:
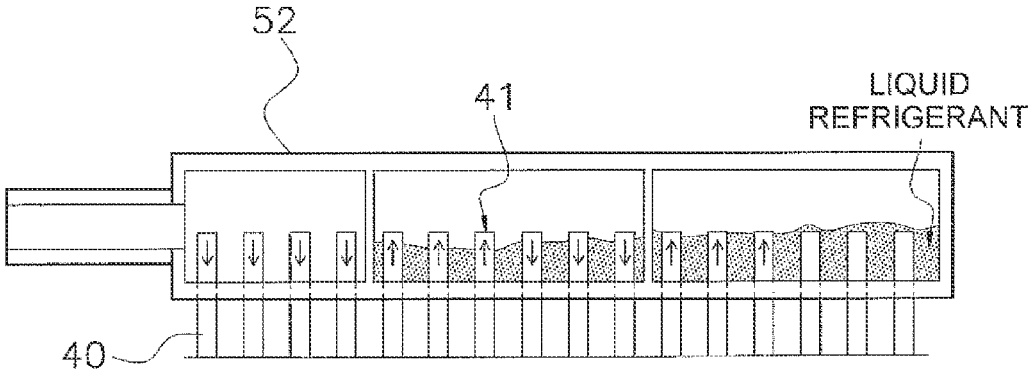
Figure 14:
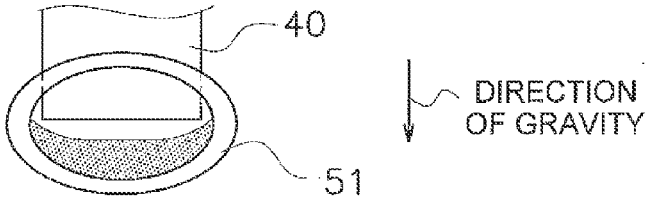
FIG. 14 is a view describing a state in which a liquid refrigerant has pooled in the interior of a refrigerant header arranged at the bottom.
Figure 14:
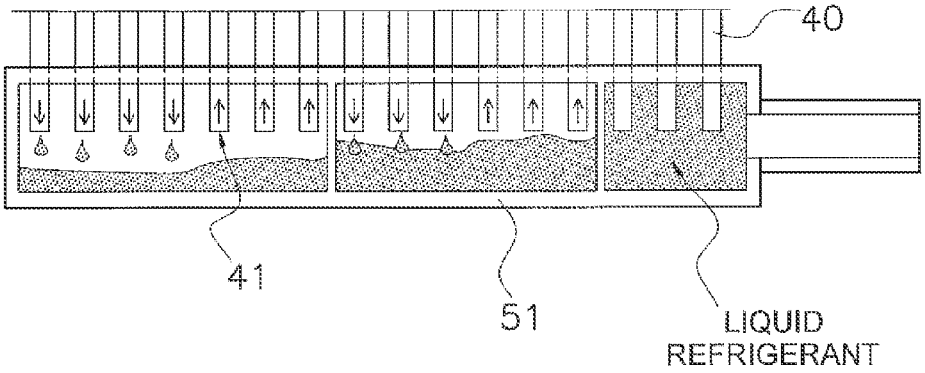

FIG. 12 is a view showing a state in which a heat exchanger has been installed in a state in which the refrigerant headers 50 are arranged to extend along the horizontal direction, and the multi-hole flat, tubes 40 are arranged to extend along the vertical direction. FIG. 13(*a*) is a cross-sectional view of the refrigerant header 52 of the heat exchanger in the state shown in FIG. 12, in the case of being cut along a direction orthogonal to the lengthwise direction thereof. FIG. 13(*b*) is a cross-sectional view of the refrigerant header 52 of the heat exchanger in the state shown in FIG. 12, in the case of being cut along the lengthwise direction thereof. FIG. 14(*a*) is a cross-sectional view of the refrigerant header 51 of the heat exchanger in the state shown in FIG. 12, in the case of being cut along a direction orthogonal to the lengthwise direction thereof. FIG. 14(*b*) is a cross-sectional view of the refrigerant header 51 of the heat exchanger in the state shown in FIG. 12, in the case of being cut along the lengthwise direction thereof.

In the aforedescribed embodiment, when the heat exchanger 10 is installed within the refrigeration apparatus 91, the refrigerant headers 50 and the multi-hole flat tubes 40 are arranged so as to extend along the horizontal direction.

Instead of the above, when the heat exchanger is installed within the refrigeration apparatus, the multi-hole flat tubes need not be arranged to extend along the horizontal direction, as long as the refrigerant headers are arranged so as to extend along the horizontal direction.

For example, as shown in FIG. 12, when the heat exchanger is installed within the refrigeration apparatus, it would be acceptable to arrange the refrigerant headers 50 to extend along the horizontal direction, and for the multi-hole flat tubes 40 to be arranged to extend along the vertical direction. In the following description, the heat exchanger installed in the state shown in FIG. 12, i.e., in a state in which the refrigerant headers 50 are arranged to extend along the horizontal direction, and the multi-hole flat tubes 40 arranged to extend along the vertical direction, will be denoted by symbol 110. The heat exchanger 110 shown in FIG. 12 has the same constitution as the heat exchanger 10 of the aforedescribed embodiment, and therefore the parts that constitute the heat exchanger 110 are assigned the same symbols as in the aforedescribed embodiment, and descriptions thereof are omitted.

In this heat exchanger 110, of the refrigerant headers 50, the refrigerant header 52 is positioned to the top, and the refrigerant header 51 is positioned to the bottom. On the side of the multi-hole flat tubes 40 which, as in the aforedescribed embodiment, are divided among a plurality of paths, the refrigerant enters the first header part 55*a* of the refrigerant header 52, branches into four of the multi-hole flat tubes 40 and flows from top to bottom to therein, and converges in the first header part 54*a* of the refrigerant header 51. Having converged, the refrigerant branches from the first header part 54*a* into three of the multi-hole flat tubes 40 and flows from bottom to top therein, and converges in the second header part 55*b* of the refrigerant header 52. Having converged, the refrigerant branches from the second header part 55*b* into three of the multi-hole flat tubes 40 and flows from top to bottom therein, and converges in the second header part 54*b* of the refrigerant header 51. Having converged, the refrigerant branches from the second header part 54*b* into three of the multi-hole flat tubes 40 and flows from bottom to top therein, and converges in the third header part 55*c* of the refrigerant header 52. Having converged, the refrigerant branches from the third header part 55*c* into three of the multi-hole flat tubes 40 and flows from top to bottom therein, converges in the third header part 54*c* of the refrigerant header 51, and outflows from the heat exchanger 110.

With this constitution, the refrigerant headers 50 of this heat exchanger 110 are arranged to extend in the horizontal direction, and therefore, as shown in FIG. 9, as compared with the case in which the refrigerant headers 50 are arranged to extend in the vertical direction, even when gaseous refrigerant has condensed and liquid refrigerant has pooled in the refrigerant header 50 interior, the surface level height of the pooled refrigerant can be lowered. Therefore, the risk that all of the refrigerant flow channels 41 of the prescribed multi-hole flat tubes 40 will become submerged in the liquid refrigerant can be reduced, and as a result, uneven flow of the refrigerant in the multi-hole flat tubes 40 can be reduced.

In so doing, diminished performance of the heat exchanger 110 can be reduced.

By arranging the multi-hole flat tubes 40 to extend along the vertical direction, the multi-hole flat tubes 40 are uniform in height, as shown in FIG. 12. For this reason, as shown in FIG. 13, even when the liquid refrigerant is retained in the refrigerant header 52 interior, the inlets of the multi-hole flat tubes 40 (the end faces of the refrigerant flow channels 41) and the surface level of the liquid refrigerant are generally parallel, and the liquid refrigerant is readily distributed uniformly among the multi-hole flat tubes 40. As a result, uneven flow of the refrigerant can be reduced.

However, arranging the multi-hole flat tubes 40 to extend along the vertical direction makes it necessary to lift the condensed liquid refrigerant against gravity, increasing the pressure loss of the refrigerant when lifted. Thus, the condensation temperature drops, and the temperature differential between the refrigerant and the water is small, so that the amount of heat exchange is smaller. Further, as shown in FIG. 14, when the liquid refrigerant is retained within the refrigerant header 51 which is arranged at the bottom, there is a possibility that the amount of refrigerant filling the header will increase. Consequently, during installation of the heat exchanger in the refrigeration apparatus, it is more preferable for the multi-hole flat tubes 40 to be arranged to extend along the horizontal direction, than to be arranged to extend along the vertical direction.

(5-2) Modification B

In the aforedescribed embodiment, as shown in FIG. 8B, the cross-section of the refrigerant header 50 when cut in a direction orthogonal to the lengthwise direction thereof is ellipsoidal and the multi-hole flat tube 40 is fitted into the refrigerant header 50 in such a way that, once the heat exchanger 10 has been installed a gap S is formed between the bottom surface 50*a* of the refrigerant header 50 interior and the bottom end 40*a* of the multi-hole flat tube 40.

However, the shape of the refrigerant header 50 is not limited thereto, as long as the gap S can be provided between the bottom surface 50*a* of the refrigerant header 50 interior and the bottom end 40*a* of the multi-hole flat tube 40, with the heat exchanger 10 in the installed state.

Figure 15:
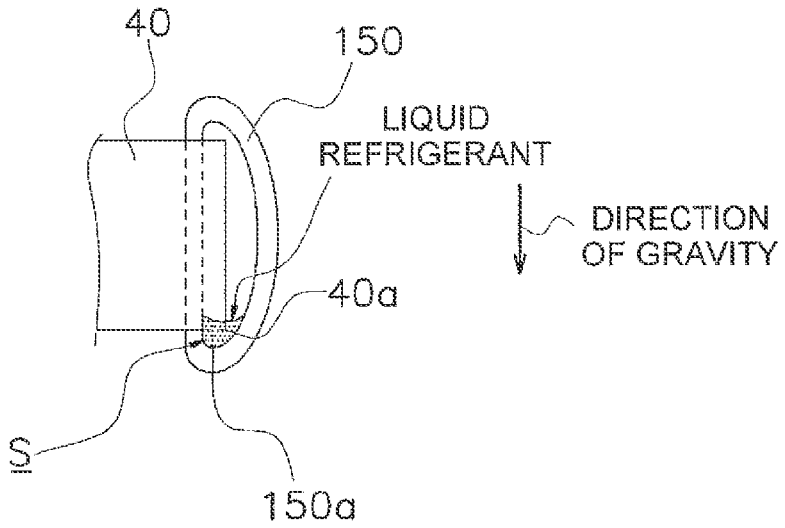
FIG. 15 is a cross-sectional view of a refrigerant header provided to a heat exchanger according to a Modification B.
Figure 16:
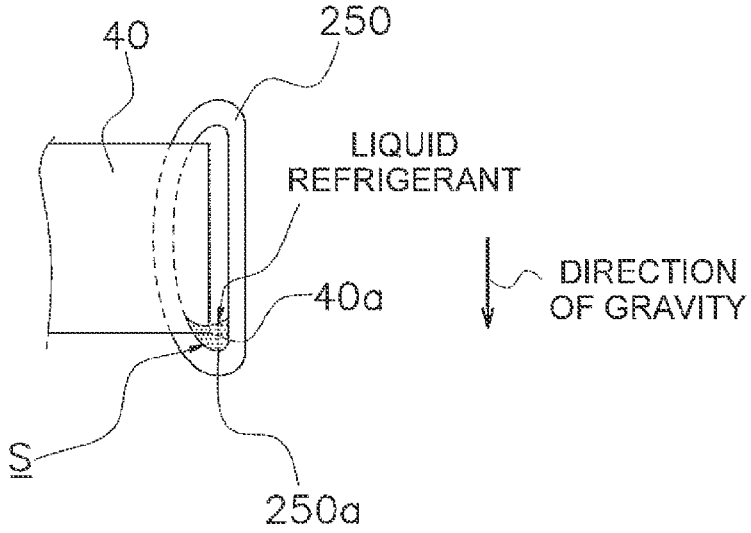
FIG. 16 is a cross-sectional view of the refrigerant header provided to a heat exchanger according to the Modification B.

For example, the refrigerant header may have a semicircular cross-section when cut in a direction orthogonal to the lengthwise direction thereof. Specifically, a refrigerant header 150 may curve so as to protrude out towards the direction in which the multi-hole flat tube 40 is fitted therein, as shown in FIG. 15; or a refrigerant header 250 may curve so as to protrude out towards opposite direction from the direction in which the multi-hole flat tube 40 is fitted therein, as shown in FIG. 16. In this way, even when the refrigerant header 150, 250 has a semicircular cross-section, when cut in a direction orthogonal to the lengthwise direction thereof by providing the gap S between the bottom surface 150*a*, 250*a* of the refrigerant header 150, 250 interior and the bottom end 40*a* of the multi-hole flat tube 40, the liquid refrigerant is able to pool in the bottom space of the refrigerant header 150, 250.

Figure 17:
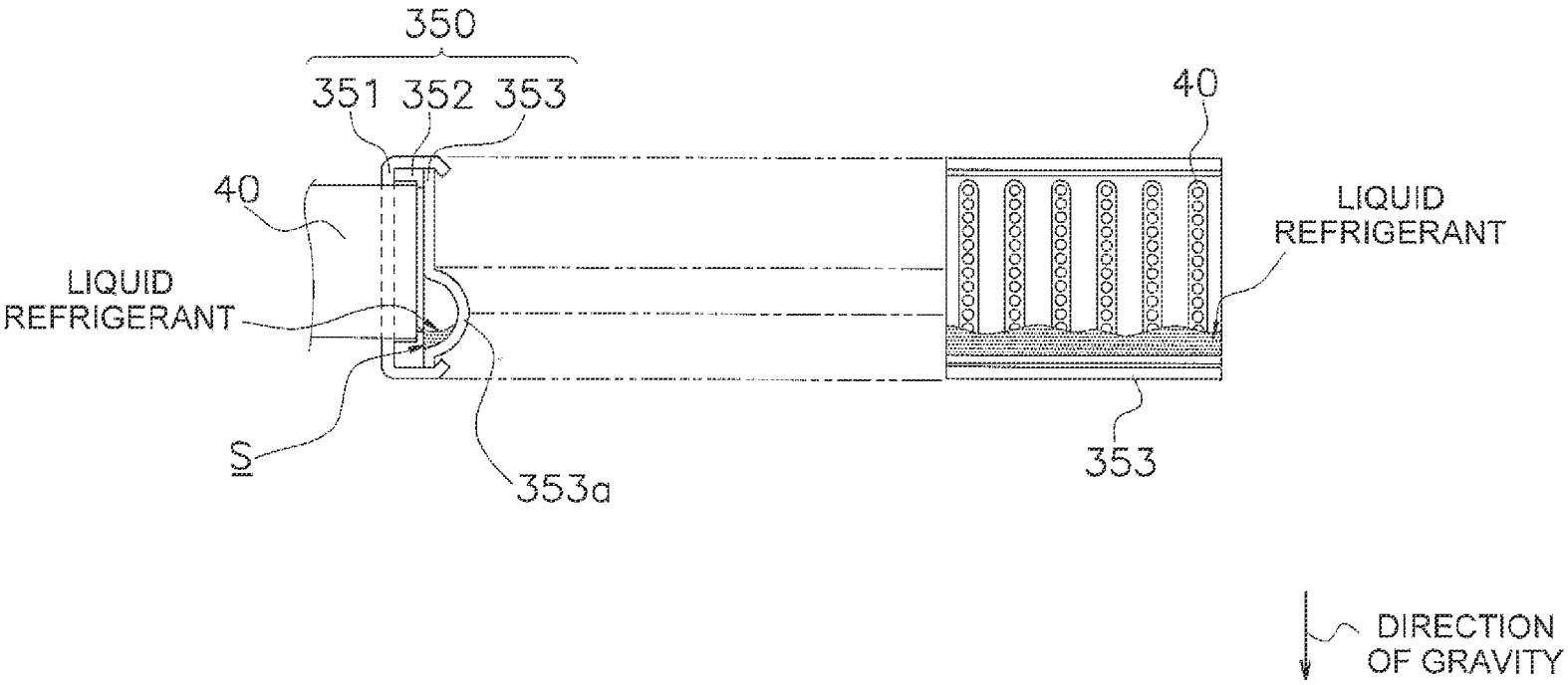
FIG. 17 is (a) a cross-sectional view of a refrigerant header and (b) a view showing a state in which a side panel has been removed from the refrigerant header, in the refrigerant header provided to a heat exchanger according to the Modification B.

The cross-sectional shape of the refrigerant header 50 when cut in a direction orthogonal to the lengthwise direction thereof may differ in the top-to-bottom direction, with the heat exchanger 10 in the installed state. For example, as shown in FIG. 17, in a case in which a refrigerant header 350 is a stacked type header having a bonded panel 351, a spacer 352, and a side panel 353, a portion of the side panel 353 may be constituted so as to protrude outward. By installing the heat exchanger 10 such that a protruding section 353*a* of the side panel 353 in the refrigerant header 350 is positioned to the bottom, a large space in which the liquid refrigerant can pool can be created.

Figure 18:
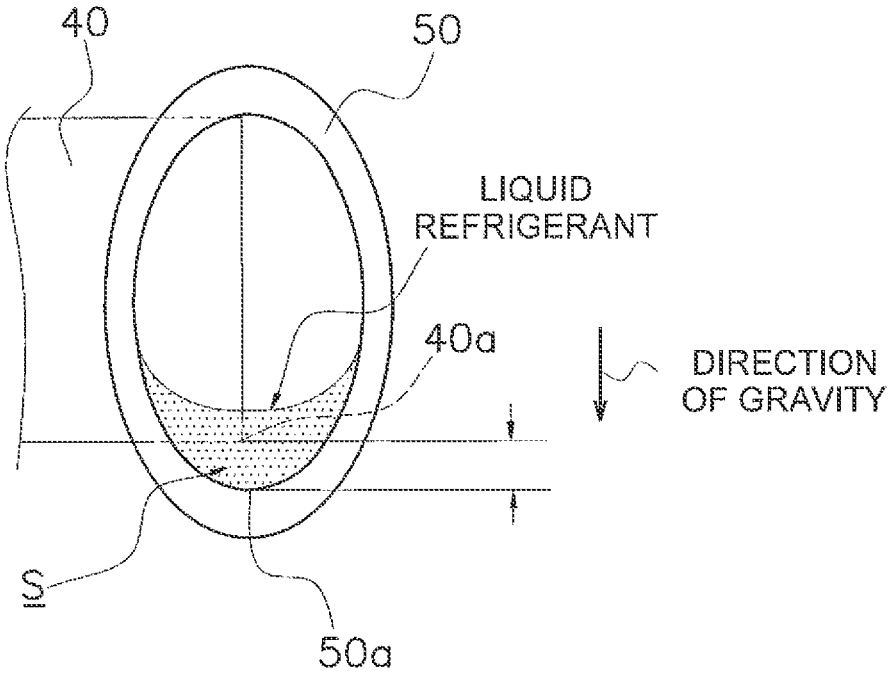
FIG. 18 is a cross-sectional view of the refrigerant header provided to a heat exchanger according to the Modification B.

Further, as shown in FIG. 18, even when the cross-sectional shape of the refrigerant header 50 when cut in a direction orthogonal to the lengthwise direction thereof has vertical symmetry, the multi-hole flat tube 40 may be fitted eccentrically into the refrigerant header 50, thus increasing the size of the gap S between the bottom surface 50*a* of the refrigerant header 50 interior and the bottom end 40*a* of the multi-hole flat tube 40.

In this way, by fitting the multi-hole flat tube 40 into the refrigerant header 50, 150, 250, 350 in such a way that the gap S forms between the bottom surface 50*a*, 150*a*, 250*a*, 350*a* of the refrigerant header 50, 150, 250, 350 interior and the bottom end 40*a* of the multi-hole flat tube 40, space for the liquid refrigerant to pool within the refrigerant header 50, 150, 250, 350 can be ensured. Due to the presence of the space for the liquid refrigerant to pool within the refrigerant header 50, 150, 250, 350 in this way, the liquid refrigerant pools in the space during operation of the heat exchanger 10, and the surface level thereof reaches the liquid refrigerant flow channel 41 that, of the liquid refrigerant flow channels 41 lined up along the vertical direction, is in the bottommost part, whereby the liquid refrigerant can be discharged from the liquid refrigerant flow channel 41 positioned in the bottommost part.

(5-3) Modification C

In the aforedescribed embodiment and Modification, the plurality of refrigerant flow channels 41 formed in the multi-hole flat tubes 40 are all identical. Therefore, the planar dimensions of the flow channel cross-sections of all of the refrigerant flow channels 41 are identical.

Figure 19:
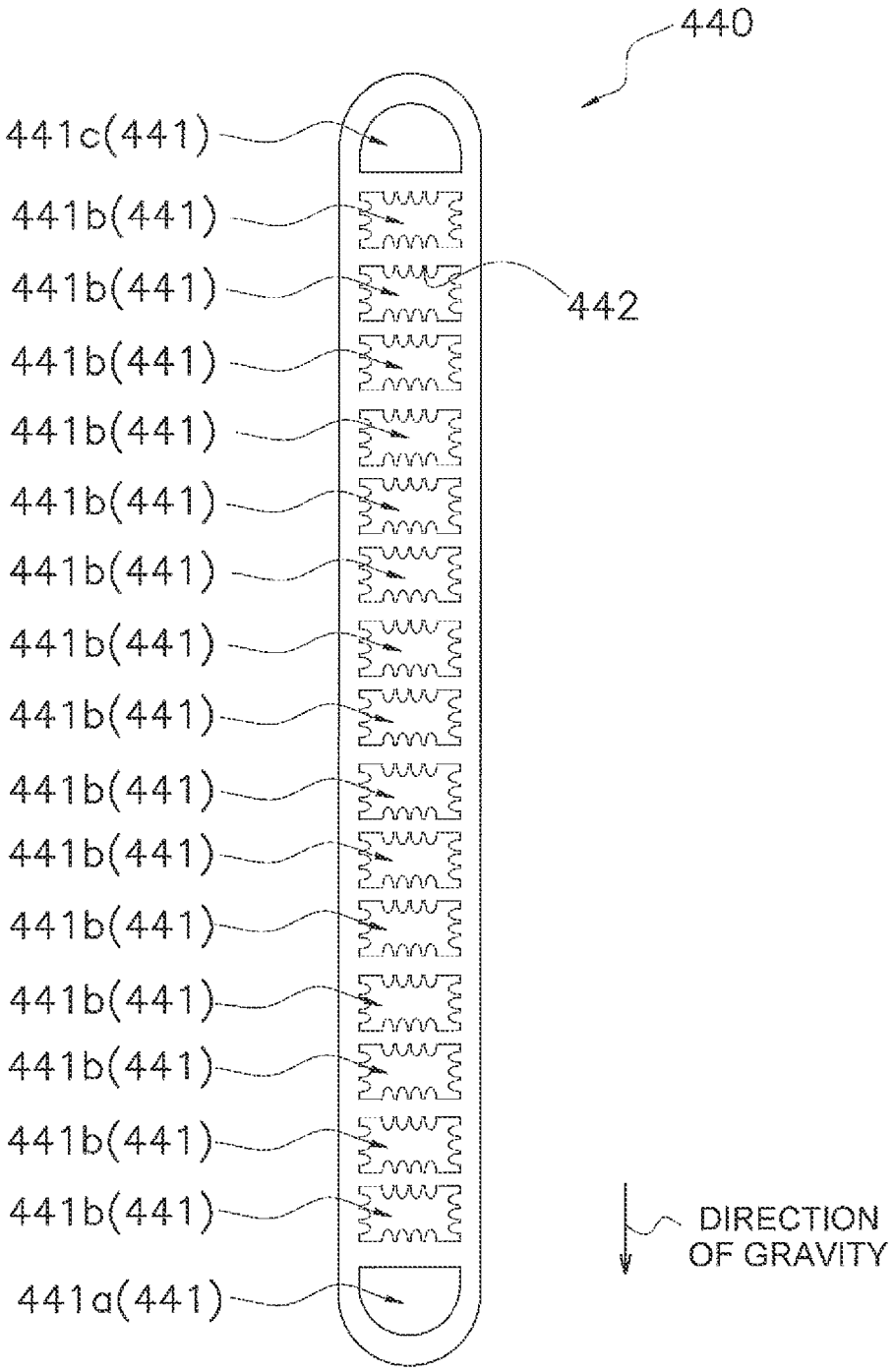
FIG. 19 is a cross-sectional view of a multi-hole flat tube provided, to a heat exchanger according to a Modification C.

Instead of this, as shown in FIG. 19, it would be acceptable for the refrigerant flow channels 441*a*, 441*c* that are positioned at the ends among the plurality of refrigerant flow channels 441 formed in the multi-hole flat tubes 440 to be provided with a flow channel cross-section larger than the flow channel cross-section of the other refrigerant flow channels 441*b*. In this case, when the heat exchanger 10 has been installed, the planar dimensions of the flow channel cross-section of the lowermost tier refrigerant flow channel 441*a* that is positioned lowermost among the plurality of refrigerant flow channels 441 lined up in the vertical direction (direction of gravity) are larger than the planar dimensions of the flow channel cross-section of the upper tier refrigerant flow channels 441*b* which are positioned above the lowermost tier refrigerant flow channel 441*a*, and therefore, as compared with the case in which the flow channel cross-sections of all of the refrigerant flow channels 441 have identical planar dimensions, flow resistance in the lowermost tier refrigerant flow channel 441*a* can be reduced, and as a result, the liquid refrigerant pooling within the refrigerant header 350 can flow smoothly. As a result, the heat exchange efficiency of the heat exchanger 10 can be improved.

Further, as shown in FIG. 19, grooves 442 for heat transfer promotion may be formed on surfaces constituting the refrigerant flow channels 441*b* other than the refrigerant flow channels 441*a*, 441*c* positioned at the ends, among the plurality of refrigerant flow channels 441 formed in the multi-hole flat tubes 440. Specifically, the grooves 442 for heat transfer promotion need not be formed on the surfaces constituting the refrigerant flow channels 441*a*, 441*c* positioned at the ends, among the plurality of refrigerant flow channels 441 formed in the multi-hole flat tubes 440. In so doing, as compared with the case in which the grooves 442 for heat transfer promotion are also formed on surfaces constituting the refrigerant flow channels 441*a*, 441*c* positioned at the ends, the flow resistance in the lowermost tier refrigerant flow channel 441*a* can be reduced, and as a result, the liquid refrigerant pooled within, the refrigerant header 350 can flow smoothly. As a result, the heat exchange efficiency of the heat exchanger 10 can be improved.

The multi-hole flat tubes 440 of the present modification can be applied not only to the aforedescribed embodiment, but also to heat exchangers according to the other modification. By applying the multi-hole flat tubes 440 of the present modification to refrigerant headers constituted to have a larger space for the liquid refrigerant to pool, as in the aforedescribed Modification B, the heat exchange efficiency of the heat exchanger 10 can be improved further.

(5-4) Modification D

Figure 20:
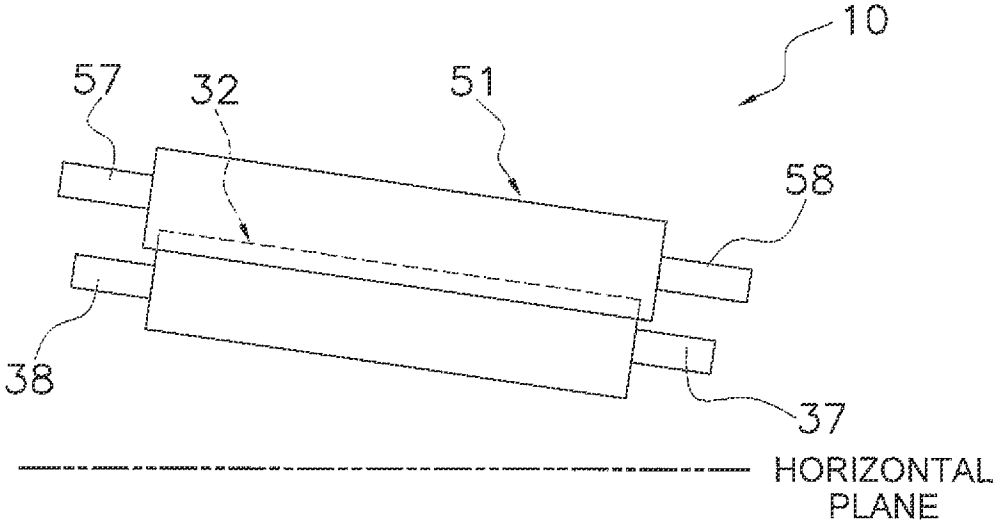
FIG. 20 is a schematic view of a heat exchanger, shown as installed by installation means according to a Modification D.
Figure 21:
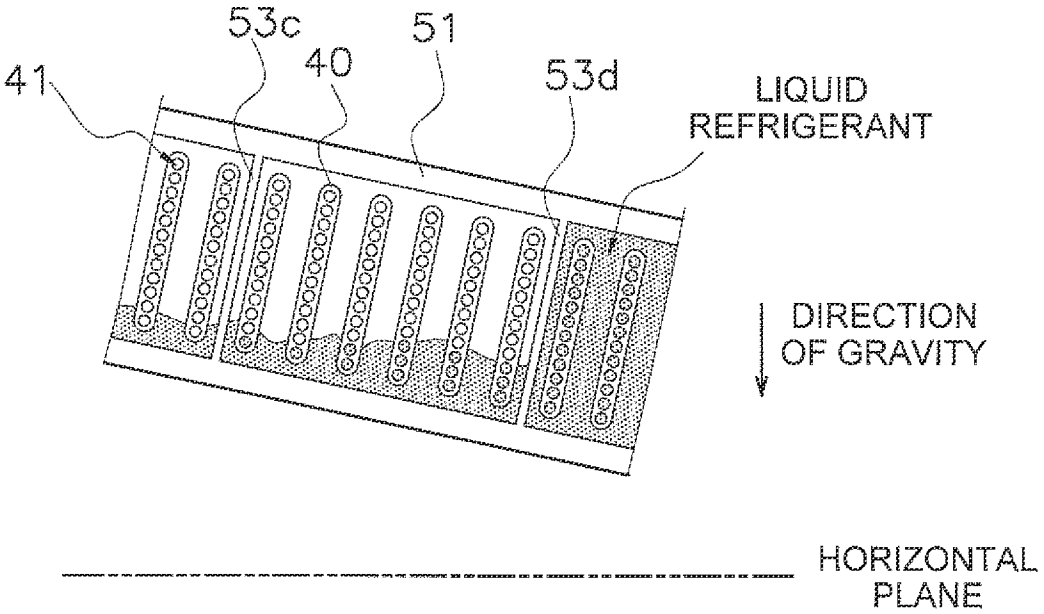
FIG. 21 is a cross-sectional view of the refrigerant header provided to a heat exchanger according to the Modification D.
Figure 22:
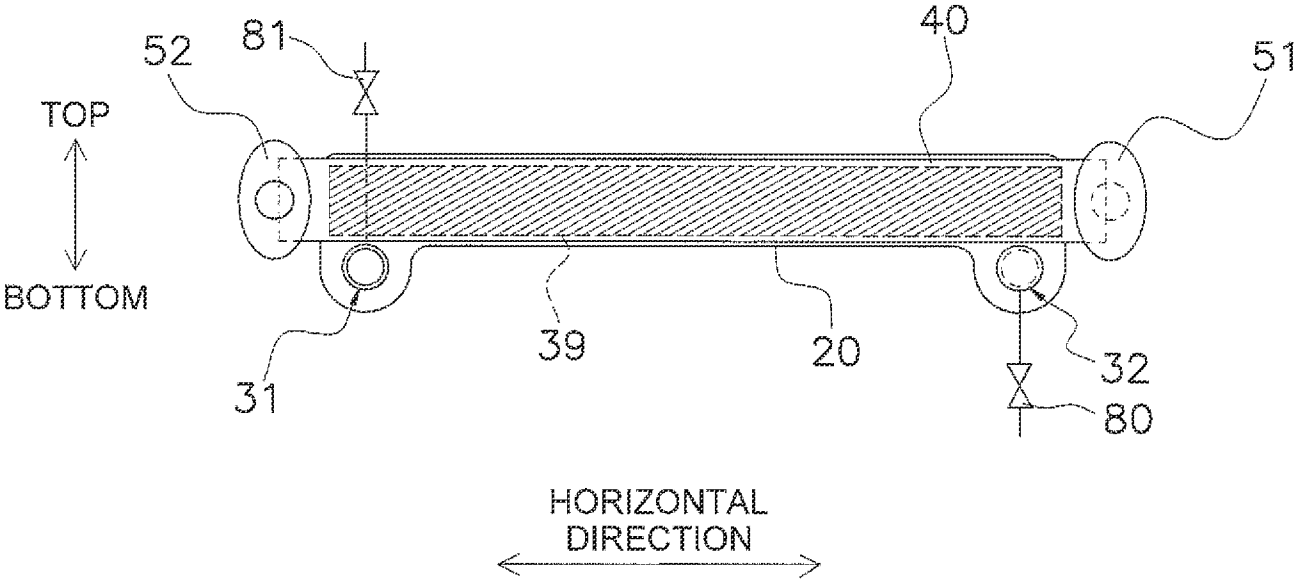
FIG. 22 is a view describing a heat transfer portion of a flat tube in the heat exchanger according to the Modification D.

FIG. 20 is a schematic view depicting the installation state of a heat exchanger 10 according to Modification D, when the heat exchanger 10 is viewed from the refrigerant header 51 side. FIG. 21 is a cross-sectional view of the refrigerant header 51 in the state shown in FIG. 20. FIG. 22 is a schematic view describing the installation state of the heat exchanger 10 according to Modification D. The hatched section in FIG. 22 indicates a heat transfer portion 39.

When the refrigeration apparatus 91 is scheduled for maintenance and/or is not to be used for extended periods of time during the winter, it is preferable to drain the heat exchanger 10 in order to prevent freezing. Draining of the heat exchanger 10 specifically refers to an operation of opening the inlet-side cock 80 provided to the inlet section 37 of the communicating portions 31, 32 of the flat tubes 20, and the outlet-side cock 81 provided to the outlet section 38, and discharging the water in the heat exchanger 10 to the outside.

In the case of draining the heat exchanger 10, either the inlet section 37 side or the outlet section 38 side, whichever is lower than the other, i.e., at a lower position, will more easily discharge the water within the heat exchanger 10 to the outside.

Thus, the heat exchanger 10 may be installed within the refrigeration apparatus 91 in such a way as to be inclined by a prescribed angle (within a range of 0° to ±15°) with respect to a horizontal plane, such that the ends of the communicating portions 31, 32 at either the inlet section 37 side or the outlet section 38 side thereof are lower than the ends of the other.

For example, in a case in which the heat exchanger 10 is installed inclined by 10° with respect to the horizontal plane in such a way that the respective ends of the communicating portions 31, 32 at the side where the inlet section 37 is located are positioned below the respective ends of the communicating portions 31, 32 at the side where the outlet section 38 is located (see FIG. 20), the water within the heat exchanger 10 can be more easily discharged from the inlet-side cock 80, than when the heat exchanger 10 is installed in a state in which the communicating portions 31, 32 are not inclined at all with respect to the horizontal plane.

Further, in a case in which the heat exchanger 10 is installed inclined by 10° with respect to the horizontal plane in such a way that the respective ends of the communicating portions 31, 32 at the side where the inlet section 37 is located are positioned below the respective ends of the communicating portions 31, 32 at the side where the outlet section 38 is located, the respective ends of the refrigerant headers 51, 52 at the side where the outlet section 58 is located will be positioned below the respective ends of the refrigerant headers 51, 52 at the side where the inlet section 57 is located (see FIGS. 20 and 21). Here, in the case in which the heat exchanger 10 functions as a condenser, the gaseous refrigerant that has entered from the inlet section 57 undergoes phase change from a gaseous refrigerant to a liquid refrigerant through heat exchange, and the outflow from the outlet section 58 is primarily the liquid refrigerant. In this way, when the heat exchanger 10 functions as a condenser, by installing the heat exchanger 10 in such a way that the respective ends of the refrigerant headers 51, 52 at the side where the outlet section 58 is located are positioned below the respective ends of the refrigerant headers 51, 52 at the side where the inlet section 57 is located, the liquid refrigerant flows out from the outlet section 58 more easily than when the heat exchanger 10 is installed in a state in which the refrigerant headers 51, 52 are not inclined at all with respect to the horizontal plane, and therefore the risk of the liquid refrigerant collecting within the heat exchanger 10 can be reduced.

Further, as shown in FIG. 22, in a case in which heat exchanger 10 is installed in such a way that the section 39 of the flat tube 20 other than the communicating portions 31, 32 (hereinafter termed a "heat transfer portion"), which is the section that contacts the multi-hole flat tube 40, is arranged above the communicating portions 31, 32, it is more difficult for water to collect in the heat transfer portion 39, as compared with the case in which the heat exchanger 10 is installed such that the heat transfer portion 39 is arranged below the communicating portions 31, 32, and therefore the water that has pooled within the heat exchanger 10 is easily discharged. In so doing, the operation to drain the heat exchanger 10 can be simplified.

(5-5) Modification E

In the aforedescribed embodiment and the aforedescribed modifications, a case in which the heat exchanger functions only as a condenser was described by way of example, but there is no limitation thereto, and the heat exchanger of the present invention may also function as both a condenser and an evaporator.

INDUSTRIAL APPLICABILITY

The present invention relates to a heat exchanger capable of reducing any decrease in performance, the heat exchanger being effective for applications oriented to heat exchangers in which a plurality of flat tubes and a plurality of multi-hole flat tubes are stacked in alternating fashion, and which are provided with headers extending in a direction intersecting the lengthwise direction of the multi-hole flat tubes.

What is claimed is:

1. A heat exchanger adapted to carry out heat exchange between a refrigerant that undergoes a phase change during heat exchange and another heating medium, the heat exchanger comprising:

headers having the refrigerant flowing through interiors thereof;

a plurality of multi-hole first flat tubes extending in a horizontal direction intersecting a lengthwise direction of the headers, the multi-hole first flat tubes having a plurality of refrigerant flow channels formed therein, with the refrigerant flowing through the refrigerant flow channels; and a plurality of second flat tubes stacked alternately with respect to the plurality of multi-hole first flat tubes, the other heating medium flowing through the second flat tubes, the headers being arranged to extend along a horizontal direction, the plurality of refrigerant flow channels formed in the multi-hole first flat tubes are arranged to line up with each other along a vertical direction, and a flow channel cross-section of a lowermost tier refrigerant flow channel positioned lowermost of the plurality of refrigerant flow channels being larger than a flow channel cross-section of upper tier refrigerant flow channels positioned above the lowermost tier refrigerant flow channel.

2. The heat exchanger according to claim 1, wherein grooves promoting heat transfer promotion are formed on surfaces of the upper tier refrigerant flow channels, but are not formed on surfaces of the lowermost tier refrigerant flow channel.

3. A heat exchanger adapted to carry out heat exchange between a refrigerant that undergoes a phase change during heat exchange and another heating medium, the heat exchanger comprising:

headers having the refrigerant flowing through interiors thereof;

a plurality of multi-hole first flat tubes extending in a horizontal direction intersecting a lengthwise direction of the headers, the multi-hole first flat tubes having a plurality of refrigerant flow channels formed therein, with the refrigerant flowing through the refrigerant flow channels; and a plurality of second flat tubes stacked alternately with respect to the plurality of multi-hole first flat tubes, the other heating medium flowing through the second flat tubes, the headers being arranged to extend along a horizontal direction, the headers including a header inlet section to receive the refrigerant and a header outlet section to outlet the refrigerant, the plurality of multi-hole first flat tubes communicating via communicating portions that include a tube inlet section to receive the other heating medium and a tube outlet section to outlet the other heating medium, the communicating portions extending along the lengthwise direction of the headers, the headers being arranged such that a header outlet section side is positioned below a header inlet section side, the second flat tubes including a heat transfer portion contacting the multi-hole first flat tubes, and the communicating portions being arranged below the heat transfer portion.

4. The heat exchanger according to claim 1, wherein when the multi-hole first flat tubes have been fitted into the headers, a gap is formed between a bottom surface of the header interior and a bottom end of the multi-hole first flat tubes.

5. The heat exchanger according to claim 2, wherein when the multi-hole first flat tubes have been fitted into the headers, a pan is formed between a bottom surface of the header interior and a bottom end of the multi-hole first flat tubes.

6. The heat exchanger according to claim 4, wherein the headers include a header inlet section to receive the refrigerant and a header outlet section to outlet the refrigerant, the plurality of multi-hole first flat tubes communicate via communicating portions that include a tube inlet section to receive the other heating medium and a tube outlet section to outlet the other heating medium, the communicating portions extend along the lengthwise direction of the headers, and the headers are arranged such that a header outlet section side is positioned below a header inlet section side.

7. The heat exchanger according to claim 2, wherein the headers include a header inlet section to receive the refrigerant and a header outlet section to outlet the refrigerant, the plurality of multi-hole first flat tubes communicate via communicating portions that include a tube inlet section to receive the other heating medium and a tube outlet section to outlet the other heating medium, the communicating portions extend along the lengthwise direction of the headers, and the headers are arranged such that a header outlet section side is positioned below a header inlet section side.

8. The heat exchanger according to claim 1, wherein the headers include a header inlet section to receive the refrigerant and a header outlet section to outlet the refrigerant, the plurality of multi-hole first flat tubes communicate via communicating portions that include a tube inlet section to receive the other heating medium and a tube outlet section to outlet the other heating medium, the communicating portions extend along the lengthwise direction of the headers, and the headers are arranged such that a header outlet section side is positioned below a header inlet section side.

9. The heat exchanger according to claim 5, wherein the headers include a header inlet section to receive the refrigerant and a header outlet section to outlet the refrigerant, the plurality of multi-hole first flat tubes communicate via communicating portions that include a tube inlet section to receive the other heating medium and a tube outlet section to outlet the other heating medium, the communicating portions extend along the lengthwise direction of the headers, and the headers are arranged such that a header outlet section side is positioned below a header inlet section side.

* * * * *